US007129012B2

(12) United States Patent
Sekiya et al.

(10) Patent No.: US 7,129,012 B2
(45) Date of Patent: Oct. 31, 2006

(54) ELECTROPHOTOGRAPHIC PHOTOSENSITIVE MEMBER, PROCESS CARTRIDGE, AND ELECTROPHOTOGRAPHIC APPARATUS

(75) Inventors: Michiyo Sekiya, Mishima (JP); Hideaki Nagasaka, Sunto-gun (JP); Kunihiko Sekido, Numazu (JP); Nobumichi Miki, Sunto-gun (JP); Yosuke Morikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 11/159,164

(22) Filed: Jun. 23, 2005

(65) Prior Publication Data

US 2005/0238974 A1 Oct. 27, 2005

Related U.S. Application Data

(63) Continuation of application No. PCT/JP04/19389, filed on Dec. 24, 2004.

(30) Foreign Application Priority Data

Dec. 26, 2003 (JP) ..... 2003-434013

(51) Int. Cl.
*G03G 5/06* (2006.01)

(52) U.S. Cl. ..... 430/59.4; 430/58.05; 430/59.1; 399/159

(58) Field of Classification Search ..... 430/59.4, 430/58.05, 59.1; 399/159
See application file for complete search history.

(56) References Cited

U.S. PATENT DOCUMENTS

| | | | | |
|---|---|---|---|---|
| 5,370,953 | A | 12/1994 | Nakatani | 430/58 |
| 5,534,980 | A | 7/1996 | Tanaka | 355/219 |
| 6,127,076 | A | 10/2000 | Ishigami et al. | 430/58.5 |
| 6,403,270 | B1 * | 6/2002 | Itami et al. | 430/59.5 |
| 2002/0061454 | A1 * | 5/2002 | Tanaka et al. | 430/59.2 |

FOREIGN PATENT DOCUMENTS

| | | | |
|---|---|---|---|
| JP | H02-136860 | | 5/1990 |
| JP | H02-136861 | | 5/1990 |
| JP | H02-146048 | | 6/1990 |
| JP | H02-146049 | | 6/1990 |
| JP | H02-146050 | | 6/1990 |
| JP | 05-27457 | A | 2/1993 |
| JP | H05-150498 | | 6/1993 |
| JP | H06-313974 | | 11/1994 |
| JP | H07-104495 | | 4/1995 |
| JP | 08-050435 | A | 2/1996 |
| JP | H11-172142 | | 6/1999 |
| JP | 11-343291 | A | 12/1999 |
| JP | 2000-019758 | A | 1/2000 |
| JP | 2000-039730 | | 2/2000 |
| JP | 2000-292946 | | 10/2000 |
| JP | 2002-091039 | | 3/2002 |
| JP | 2002-296817 | | 10/2002 |
| JP | 2003-327587 | A | 11/2003 |
| JP | 2003-345048 | A | 12/2003 |

* cited by examiner

*Primary Examiner*—John L. Goodrow
(74) *Attorney, Agent, or Firm*—Fitzpatrick, Cella, Harper & Scinto

(57) ABSTRACT

An electrophotographic photosensitive member which has $V_A$, $V_B$, and d satisfying an expression $(|-600-V_A|-|-600-V_B|)/d=0.13$ and $V_C$ satisfying an expression $-5=-(-450-V_C)=2$ provides an excellent suppressing effect on ghost images and hardly causes a ghost phenomenon even when it is mounted on a color electrophotographic apparatus or an electrophotographic apparatus having no electrostatic removal device. The invention also relates to a process cartridge and an electrophotographic apparatus each having such an electrophotographic photosensitive member.

6 Claims, 9 Drawing Sheets

ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to: an electrophotographic photosensitive member; and a process cartridge and an electrophotographic apparatus each having an electrophotographic photosensitive member.

BACKGROUND ART

In recent years, electrophotographic photosensitive members each having a photosensitive layer containing an organic charge generation substance and an organic charge transport substance (organic electrophotographic photosensitive members) have been vigorously used for electrophotographic apparatuses such as a copying machine and a printer. Photosensitive layers each having a laminated (forward-laminated) layer configuration have been in the mainstream of such photosensitive layers from the viewpoint of durability, the photosensitive layers each having a laminated (forward-laminated) layer configuration being obtained by laminating a charge generation layer containing a charge generation substance and a charge transport layer (hole transport layer) containing a charge transport substance (hole transport substance) on the side of a support.

Of the charge generation substances, a charge generation substance having sensitivity in a red or infrared region is used for an electrophotographic apparatus to be mounted on, for example, a laser beam printer that has remarkably developed in recent years, and the frequency at which such a charge generation substance is demanded is increasing. Known examples of a charge generation substance having a sensitivity in an infrared region include: phthalocyanine pigments such as oxytitanium phthalocyanine, hydroxygallium phthalocyanine, and chiorogallium phthalocyanine; and azo pigments such as monoazo, bisazo, and trisazo pigments.

However, when a charge generation substance having high sensitivity is used, there arises a problem in that the amount of charge to be generated is large, an electron after injection of a hole into a hole transport layer is apt to reside in a charge generation layer, and a memory is apt to occur. To be specific, a so-called positive ghost in which the density of only a portion irradiated with light at the time of forward rotation in an output image increases, or a so-called negative ghost in which the density of only a portion irradiated with light at the time of forward rotation in an output image decreases is observed As a conventional technique for suppressing such ahost phenomena, JP-A 11-172142 (Patent Document 1) and JP-A 2002-091039 (Patent Document 2) each disclose a technique involving the use of type-II chlorogallium phthalocyanine as a charge generation substance, JP-A 07-104495 (Patent Document 3) discloses a technique involving incorporating an acceptor compound into a charge generation layer using oxytitanium phthalocyanine, JP-A 2000-292946 (Patent Document 4) and JP-A 2002-296817 (Patent Document 5) each disclose a technique involving incorporating a dithiobenzyl compound into a charge generation layer using phthalocyanine, and JP-A 02-136860 (Patent Document 6), JP-A 02-136861 (Patent Document 7), JP-A 02-146048 (Patent Document 8), JP-A 02-146049 (Patent Document 9), JP-A 02-146050 (Patent Document 10), JP-A 05-150498 (Patent Document 11), JP-A 06-313974 (Patent Document 12), and JP-A 2000-039730 (Patent Document 13) each disclose a technique involving incorporating an electron transport substance, an electron accepting substance, or an electron aspirating substance into a charge generation layer.

Patent Document 1: JP-A 11-172142
Patent Document 2: JP-A 2002-091039
Patent Document 3: JP-A 07-104495
Patent Document 4: JP-A 2000-292946
Patent Document 5: JP-A 2002-296817
Patent Document 6: JP-A 02-136860
Patent Document 7: JP-A 02-136861
Patent Document 8: JP-A 02-146048
Patent Document 9: JP-A 02-146049
Patent Document 10: JP-A 02-146050
Patent Document 11: JP-A 05-150498
Patent Document 12: JP-A 06-313974
Patent Document 13: JP-A 2000-039730

DISCLOSURE OF THE INVENTION

Problems to be Solved by the Invention

Recent developments in electrophotographic techniques are remarkable, and hence more high-quality characteristics have been demanded for an electrophotographic photosensitive member.

For example, monotone images, such as a letter, have been conventionally dominant, but demands for color images, such as a photograph, have been increasing in recent years. In addition, requirements for the image quality of such images have become more severe year by year.

The ghost phenomena described above are apt to appear particularly on halftone images. In addition, such phenomena are matters of particular concern in color images each of which is often obtained by superimposing halftone images.

In the case of a color image, even if the ghost level of a color is the same as that of a monotone image, the ghost phenomena are apt to manifest themselves when multiple colors are superimposed.

Electrostatic removal means such as pre-exposure may be arranged in an electrophotographic apparatus as means for suppressing a ghost phenomenon. However, the electrostatic removal means has been often omitted due to the desire for cost reduction and size reduction of the main body of the electrophotographic apparatus.

It cannot be said that the prior art described above has a sufficient effect on the severe circumstances caused by such ghost phenomena.

An object of the present invention is to provide: an electrophotographic photosensitive member which has an excellent suppressing effect on ghost images and which hardly causes a ghost phenomenon even when it is mounted on a color electrophotographic apparatus or an electrophotographic apparatus having no electrostatic removal means; and a process cartridge and an electrophotographic apparatus each having the electrophotographic photosensitive member.

Means for Solving the Problems

According to one aspect of the present invention, there is provided an electrophotographic photosensitive member, comprising: a support; a charge generation layer containing a charge generation substance, the charge generation layer being placed on the support; and a hole transport layer containing a hole transport substance, the hole transport layer being placed on the charge generation layer, wherein the following expression (I) is satisfied $$(|-600-V_A|-|-600-V_B|)/d \leqq 0.13 \quad \text{(I)}$$

wherein $V_A$ in units of volts, represents a surface potential of the electrophotographic photosensitive member obtained by: rotating the electrophotographic photosensitive member 5 times while charging the surface of the electrophotographic photosensitive member by means of a charging device set to a predetermined charging condition $C_1$ to set the surface potential of the electrophotographic photosensitive member to −600 V; irradiating the surface of the electrophotographic photosensitive member having a surface potential of −600 V with light having a predetermined quantity of light E1 to set the surface potential of the electrophotographic photosensitive member to −150 V; and charging the surface of the electrophotographic photosensitive member having a surface potential of −150 V by means of the charging device set to the charging condition $C_1$;

wherein $V_B$ in units of volts represents a surface potential of the electrophotographic photosensitive member obtained by: rotating the electrophotographic photosensitive member 5 times while charging the surface of the electrophotographic photosensitive member by means of a charging device set to a predetermined charging condition $C_2$ to set the surface potential of the electrophotographic photosensitive member to −150 V; and charging the surface of the electrophotographic photosensitive member having a surface potential of −150 V by means of a charging device set to the same condition as the charging condition $C_1$; and wherein d in units of μm represents the thickness of the hole transport layer; and the following expression (II) is satisfied:

$$-5 \leqq -(-450-V_C) \leqq 2 \quad \text{(II)}$$

wherein $V_C$, in units of volts, represents a surface potential of the electrophotographic photosensitive member obtained by: rotating the electrophotographic photosensitive member 5 times while charging the surface of the electrophotographic photosensitive member by means of a charging device set to a predetermined charging condition $C_3$ to set the surface potential of the electrophotographic photosensitive member to a predetermined value $V_{CI}$, in units of volts; irradiating the surface of the electrophotographic photosensitive member having a surface potential of $V_{CI}$, in units of volts, with light having the same quantity of light as the quantity of light $E_1$ to set the surface potential of the electrophotographic photosensitive member to $V_{CII}$, in units of volts; charging the surface of the electrophotographic photosensitive member having a surface potential of $V_{CII}$, in units of volts, by means of the charging device set to the charging condition $C_3$ to set the surface potential of the electrophotographic photosensitive member to −600 V; and irradiating the surface of the electrophotographic photosensitive member having a surface potential of −600 V with light having a predetermined quantity of light $E_2$, wherein when the electrophotographic photosensitive member is rotated 5 times while the surface of the electrophotographic photosensitive member is charged by means of the charging device set to the charging condition $C_1$ to set the surface potential of the electrophotographic photosensitive member to −600 V and the surface of the electrophotographic photosensitive member having a surface potential of −600 V is irradiated with light having a predetermined quantity of light to set the surface potential of the electrophotographic photosensitive member to −450 V, the predetermined quantity of light is $E_2$.

According to another aspect of the present invention, there are provided a process cartridge and an electrophotographic apparatus each having the electrophotographic photosensitive member described above.

EFFECT OF THE INVENTION

According to the present invention, there can be provided: an electrophotographic photosensitive member which has an excellent suppressing effect on a ghost and which hardly causes a ghost phenomenon even when it is mounted on a color electrophotographic apparatus or an electrophotographic apparatus having no electrostatic removal means; and a process cartridge and an electrophotographic apparatus each having the electrophotographic photosensitive member.

BEST MODE FOR CARRYING OUT THE INVENTION

Hereinafter, the present invention will be described in detail.

First, a method of determining whether an electrophotographic photosensitive member satisfies the above provisions of the present invention (hereinafter, the method may be referred to as a "determination method of the present invention") will be described.

The determination method of the present invention is performed under a normal-temperature-and-normal-humidity environment (23° C., 50% RH).

Figure 1:
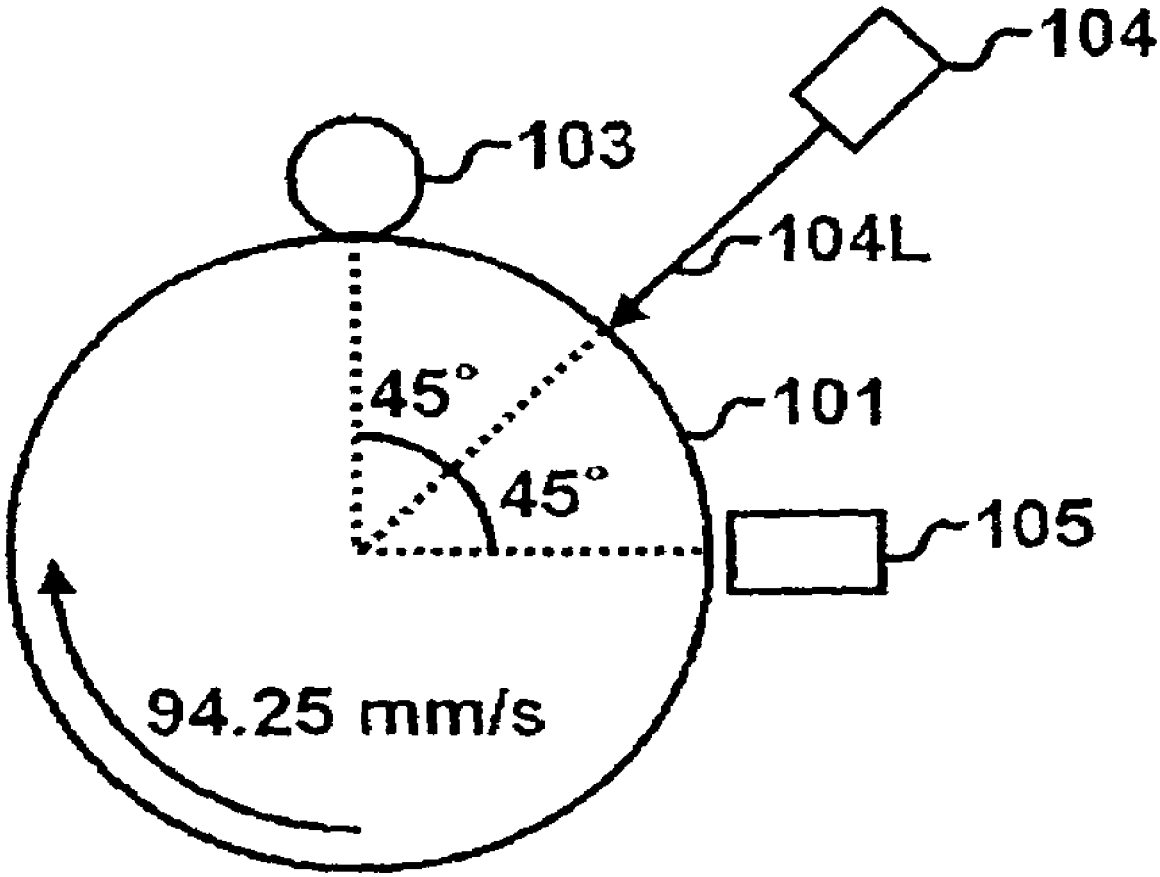
FIG. 1 is a schematic drawing showing an example of a schematic configuration of a determining device for performing a determination method of the present invention.

FIG. 1 shows an example of a schematic configuration of a determining device for performing the determination method of the present invention.

In FIG. 1, reference numeral 101 denotes an electrophotographic photosensitive member to be determined; 103 denotes a charging roller of a charging device; 104 denotes an exposing device equipped with a xenon lamp, a monochromator, and an ND filter; 104L denotes light (exposure light); and 105 denotes a potentiometer (potential probe) for measuring (reading) the surface potential of the electrophotographic photosensitive member. The electrophotographic photosensitive member 101 is rotationally driven in an arrow direction. In addition, FIG. 1 shows an electrophotographic photosensitive member having a diameter of 60 mm.

In the determination method of the present invention, the rotational speed of the electrophotographic photosensitive member is set in such a manner that the moving speed of the surface of the electrophotographic photosensitive member will be 30 II mm/s (94.25 mm/s).

A charging position charged by the charging roller 103, a position irradiated with the light 104L, that is, an exposing position, and a potential measuring position at which a potential is measured by the potentiometer 105 are set in such a manner that the time between charging and irradiation with light will be 0.25 second and the time between the irradiation with light and measurement of a potential will be 0.25 second.

Since the diameter of the electrophotographic photosensitive member 101 shown in FIG. 1 is 60 mm, each of an angle formed by the charging position, the center of the electrophotographic photosensitive member, and the exposing position and an angle formed by the exposing position, the center of the electrophotographic photosensitive member, and the potential measuring position is determined to be 45° as shown in FIG. 1 from the following expression.

$$\{(30\pi\times0.25)/60\pi\}\times360°=45°$$

Figure 2:
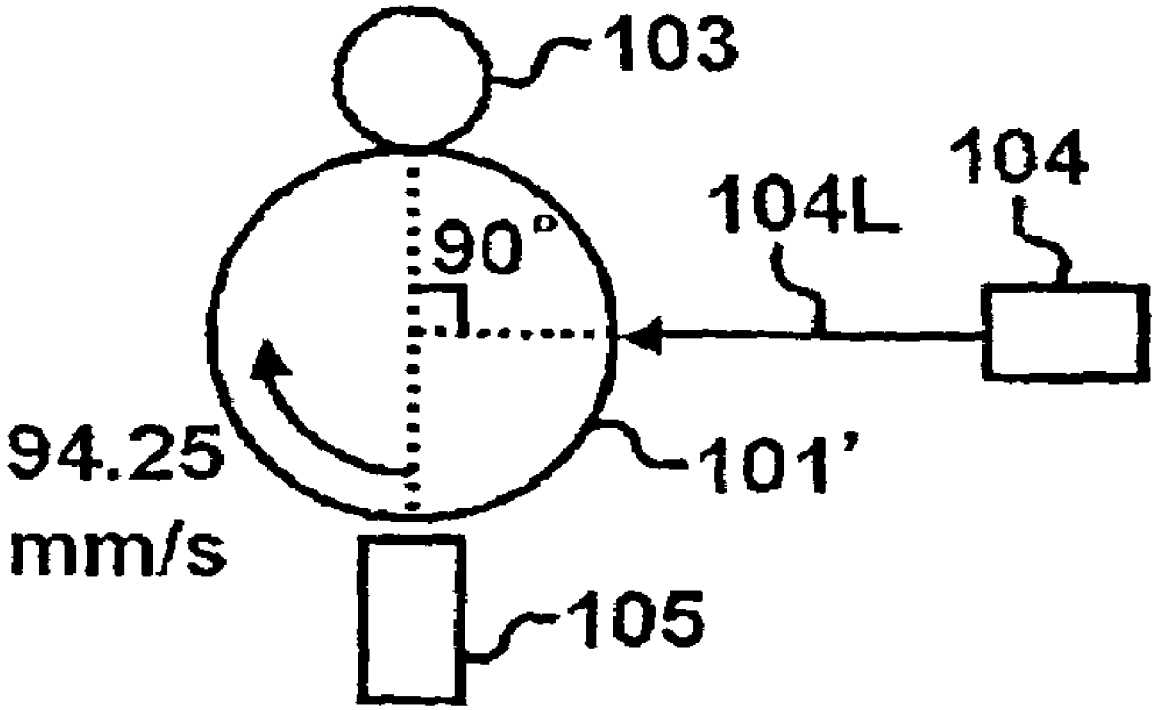
FIG. 2 is a schematic drawing showing another example of the schematic configuration of the determining device for performing the determination method of the present invention.

FIG. 2 shows another example of the schematic configuration of the determining device for performing the determination method of the present invention. Reference numeral 101' denotes an electrophotographic photosensitive member to be determined, and the other reference numerals are the same as those of Example 1. FIG. 2 shows an electrophotographic photosensitive member having a diameter of 30 mm.

As described above, in the determination method of the present invention, the rotational speed of an electrophotographic photosensitive member is set in such a manner that the moving speed of the surface of the electrophotographic photosensitive member will be 30 II mm/s, and a charging position, an exposing position, and a potential measuring position are set in such a manner that the time between charging and irradiation with light will be 0.25 second and the time between the irradiation with light and measurement of a potential will be 0.25 second. Therefore, when the diameter of the electrophotographic photosensitive member is 30 mm as shown in FIG. 2, each of an angle formed by the charging position, the center of the electrophotographic photosensitive member, and the exposing position and an angle formed by the exposing position, the center of the electrophotographic photosensitive member, and the potential measuring position is 90°.

Used as the charging roller 103 is one having a resistance per 1 cm in a longitudinal direction (the direction of the rotation axis of the charging roller) in the range of $5\times10^3$ to $5\times10^4$ Ω under each of a low-temperature-and-low-humidity environment (15° C., 10% RH), a normal-temperature-and-normal-humidity environment (23° C., 50% RH), and a high-temperature-and-high-humidity environment (30° C., 80% RH). The resistance is measured as follows.

That is, the charging roller, which was left to stand in each of the environments for 24 hours, is brought into abutment with a metal drum connected to the ground (the charging roller is pressed against the metal drum in such a manner that a force of 7.8 N (15.6 N in total) is applied to each end of the metal drum). Next, while the metal drum is rotated at a speed of 100 mm/s and the charging roller is rotated in association with the rotation, a voltage of −500 V is applied from a power source connected to the ground to a cored bar portion of the charging roller to measure a resistance value. The resistance of the charging roller can be calculated from the measured resistance value, the width between abutment portions at the time of the measurement (a nip width), and the thickness of a layer formed on the core bar of the charging roller.

In the determination method of the present invention, when the surface of the electrophotographic photosensitive member is charged, a voltage obtained by superimposing an alternating voltage to a direct voltage from the power source is applied to the charging roller. Of those, the value of the direct voltage is determined in accordance with the charging conditions described above and below. The peak-to-peak voltage and frequency of the alternating voltage are 1800 V and 870 Hz, respectively.

Monochromatic light at 780 nm obtained by subjecting light from a xenon lamp to spectroscopy by using a monochromator is used as the light 104L, and the quantity of light is adjusted by means of an ND filter.

Hereinafter, the determination method of the present invention will be described in more detail.

Figure 3:
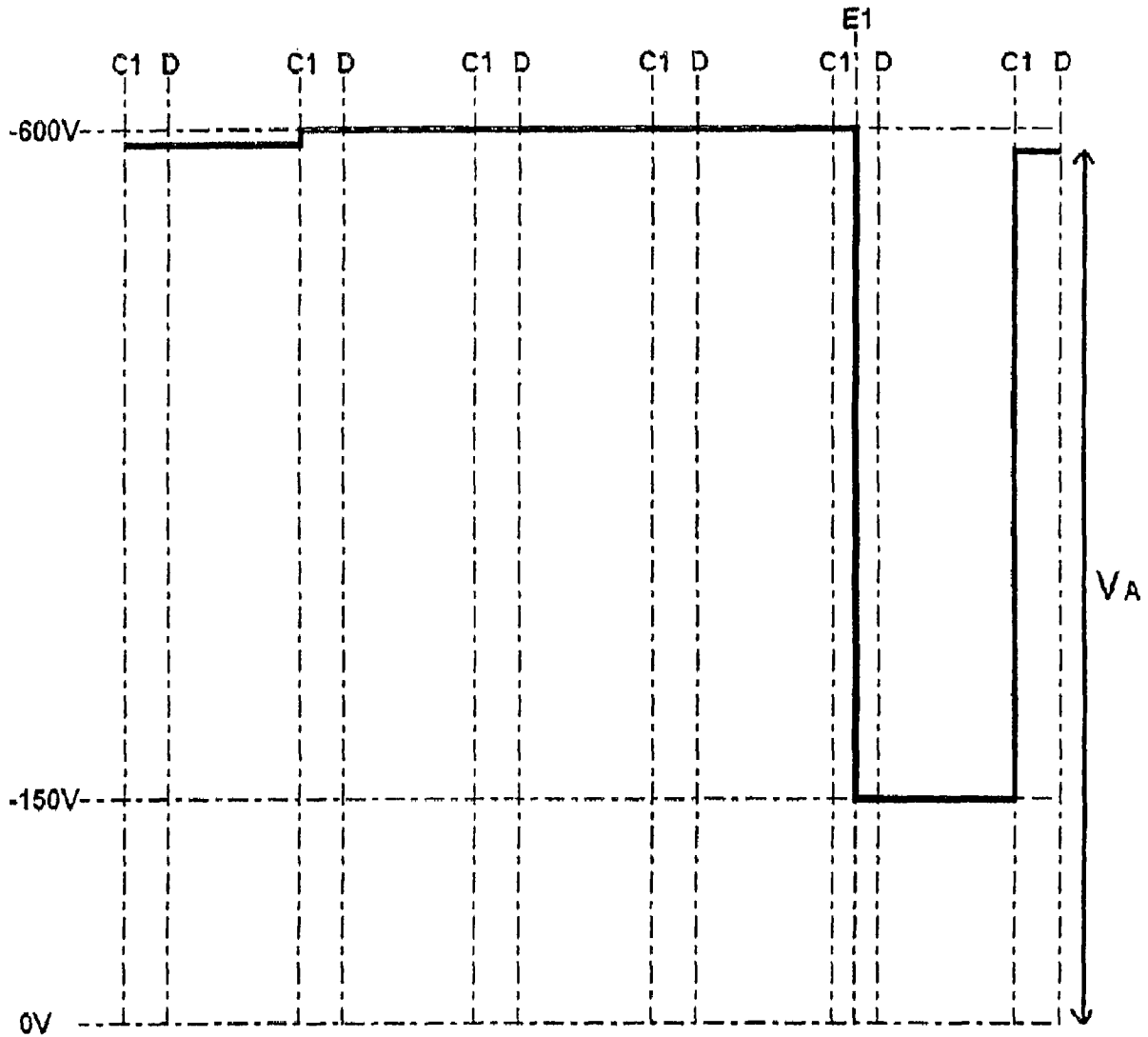
FIG. 3 is a graph for explaining "$V_A$".
Figure 4:
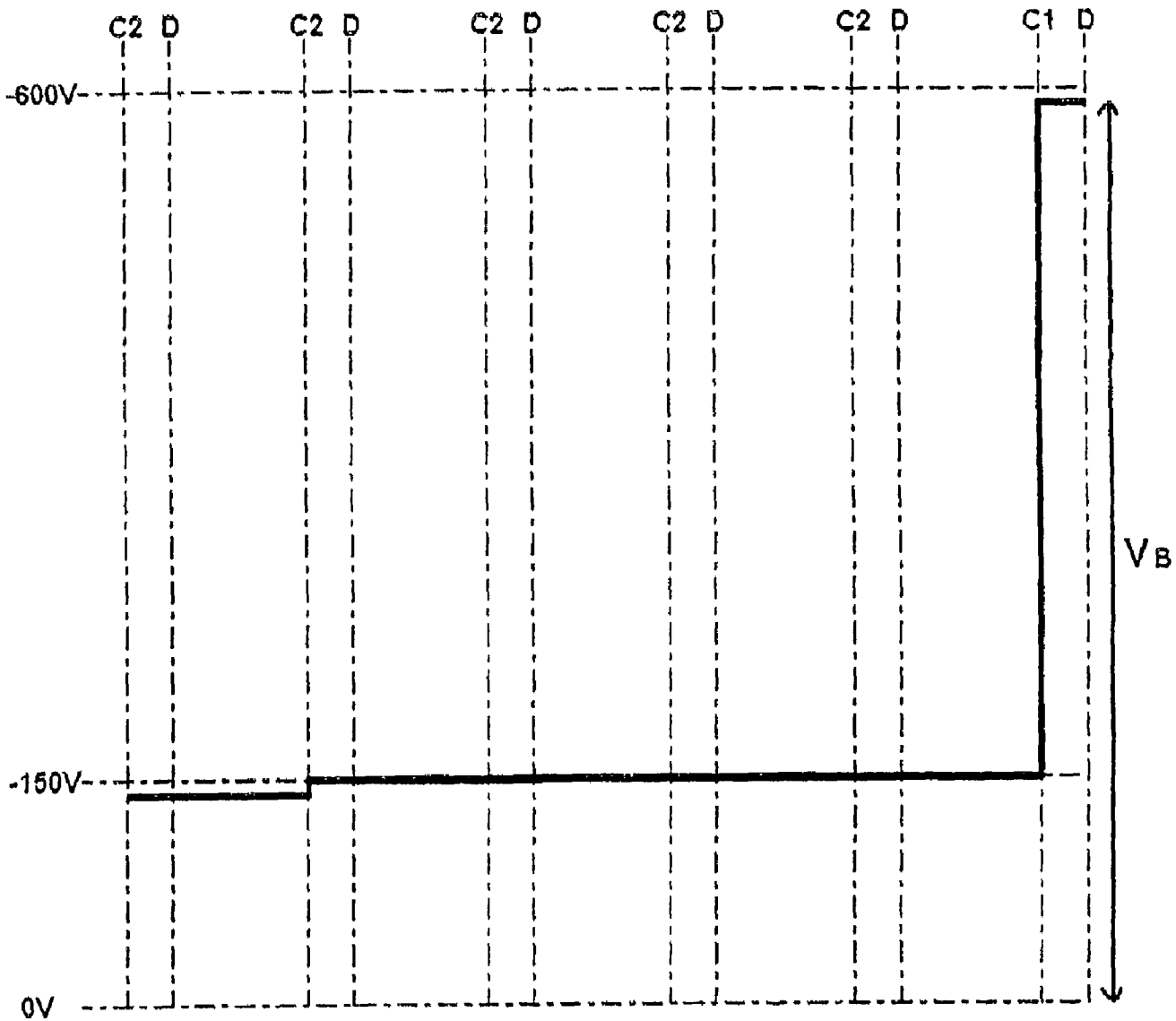
FIG. 4 is a graph for explaining "$V_B$".
Figure 5:
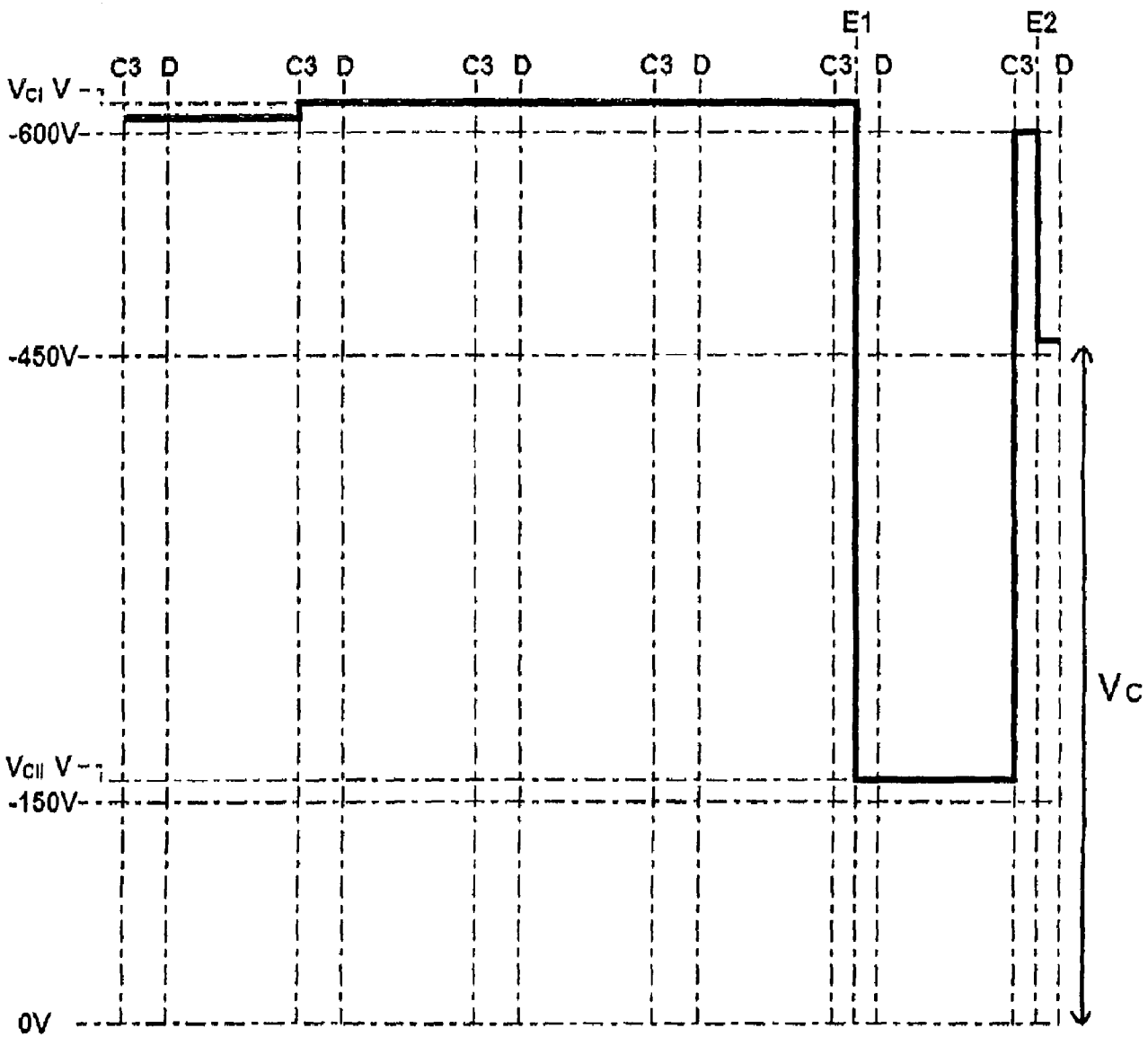
FIG. 5 is a graph for explaining "$V_C$".

FIG. 3 is a drawing for explaining "$V_A$" described above, FIG. 4 is a drawing for explaining "$V_B$" described above, and FIG. 5 is a drawing for explaining "$V_C$" described above. In FIG. 5, the absolute value of $V_H$ in units of volts is greater than that of −150 V and the absolute value of $V_C$ in units of volts is greater than that of −450 V. However, they are illustrated for explanation, and the present invention is not limited to them. In FIGS. 3 to 5, reference symbol C1 denotes charging under a charging condition $C_1$; C2 denotes charging under a charging condition $C_2$; C3 denotes charging under a charging condition $C_3$; E1 denotes irradiation with light having a quantity of light $E_1$; $E_2$ denotes irradiation with light having a quantity of light $E_2$; and D denotes measurement of a potential.

In the determination method of the present invention, the electrophotographic photosensitive member is rotated 5 times while the surface of the electrophotographic photosensitive member is charged (hereinafter, this operation may be referred to as "5-rotation charging") for the purpose of allowing charging hysteresis or exposing hysteresis remaining on the electrophotographic photosensitive member to disappear.

Hereinafter, the charging conditions $C_1$, $C_2$, and $C_3$, and the quantities of light $E_1$ and $E_2$ mentioned above will be described. Those charging conditions and quantities of light are determined prior to the determination as to whether the electrophotographic photosensitive member satisfies the above provisions of the present invention.

Charging condition $C_1$

The value of the direct voltage out of the voltages applied to the charging roller is adjusted in such a manner that the surface potential of the electrophotographic photosensitive member to be judged will be −600 V as a result of 5-rotation charging of the surface of the electrophotographic photosensitive member.

Quantity of light $E_1$

The quantity of light is adjusted by means of an ND filter in such a manner that the surface potential of the electrophotographic photosensitive member to be judged subjected to 5-rotation charging under the charging condition $C_1$ (−600 V will be attenuated to −150 V.

Charging condition $C_2$

The value of the direct voltage out of the voltages applied to the charging roller is adjusted in such a manner that the surface potential of the electrophotographic photosensitive member to be judged will be −150 V as a result of 5-rotation charging of the surface of the electrophotographic photosensitive member.

Charging condition $C_3$

The value of the direct voltage out of the voltages applied to the charging roller is adjusted in such a manner that the surface potential of the electrophotographic photosensitive member to be judged will be −600 V as a result of a series of operations consisting of: 5-rotation charging of the surface of the electrophotographic photosensitive member (the surface potential becomes $V_{CI}$ in units of volts; irradiation of the surface with light having the same quantity of light as the quantity of light $E_1$ (the surface potential becomes $V_{CII}$ in units of volts; and recharging of the surface again. The 5-rotation charging and the recharging are performed under the same charging condition.

Quantity of light E2

The quantity of light is adjusted by means of an ND filter in such a manner that the surface potential of the electrophotographic photosensitive member to be judged subjected to 5-rotation charging under the charging condition $C_1$ (−600 V will be attenuated to −450 V.

The "charging" and "irradiation with light" in the determination method of the present invention will be performed on the entirety of a largest image region on the surface of the electrophotographic photosensitive member.

Thus, $V_A$, $V_B$, and $V_C$ of the electrophotographic photosensitive member are determined.

The term $|-600-V_A|$ in the expression (I) means the extent to which an actual surface potential approximates −600 V when one tries to charge the surface of an electrophotographic photosensitive member subjected to exposure at the time of forward rotation, that is, an electrophotographic photosensitive member having exposing hysteresis to −600 V.

The experiments conducted by the inventors of the present invention have revealed that a ghost level may be small even if $|-600-V_A|$ is large and that a ghost level may be large even if $|-600-V_A|$ is small.

In addition, in some cases, even if $|-600-V_A|$ was small, a negative ghost was transformed into a positive ghost when several images were outputted. In addition, in some cases, even when no ghost was seen at an initial stage (first sheet), a positive ghost suddenly manifested itself after several images had been outputted.

As a result of extensive studies, the inventors of the present invention have found that the difference between $|600-V_A|$ and $|600-V_B|$ meaning the extent to which an actual surface potential approximates −600 V when one tries to charge the surface of an electrophotographic photosensitive member having no exposing hysteresis to −600 V ($|-600-V_A|-|-600-V_B|$) affects the occurrence of a ghost, especially a positive ghost.

The inventors have also found that a relationship between ($|-600-V_A|-|-600-V_B|$) and a ghost level varies depending on the thickness of a hole transport layer. To be specific, the larger the thickness of the hole transport layer, the less frequently a positive ghost appears on an output image.

The inventors have made investigations on the basis of those finding to thereby find that a ghost phenomenon can be successfully suppressed when $(|-600-V_A|-|-600-V_B|)/d$ (where d in units of μm represents the thickness of the hole transport layer) is equal to or less than 0.13. A positive ghost is apt to occur when $(|-600-V_A|-|-600-V_B|)/d$ is greater than 0.13.

It should be noted that $(|-600-V_A|-|-600-V_B|)/d$ is preferably equal to or greater than 0.01. If $(|-600-V_A|-|-600-V_B|)/d$ is less than 0.01, a slight negative ghost may occur at an initial stage (first sheet) or a slight positive ghost may occur after several tens of thousands of images have been outputted.

The term $-(-450-V_C)$ in the expression (II) means the extent to which an actual surface potential approximates −450 V when one tries to attenuate the surface potential of an electrophotographic photosensitive member having exposing hysteresis from −600 V to −450 V by irradiating the surface of the electrophotographic photosensitive member with light.

As a result of extensive studies, the inventors of the present invention have found that $-(-450-V_C)$ also affects the occurrence of a ghost.

The inventors have made investigations on the basis of this finding to find that a ghost phenomenon can be successfully suppressed when $-(-450-V_C)$ is equal to or greater than −5 and is equal to or smaller than 2. When $-(-450-V_C)$ is smaller than −5, a negative ghost is apt to occur even at an initial stage (first sheet). In contrast, when $-(-450-V_C)$ is greater than 2, a positive ghost is apt to occur even at an initial stage (first sheet) even if the provision of the expression (I) is satisfied.

Although the reason why a ghost phenomenon is suppressed when both the provisions of the expressions (I) and (II) are satisfied is unclear, the inventors of the present invention consider as follows.

That is, in the case of an electrophotographic photosensitive member obtained by laminating a charge generation layer and a hole transport layer in this order on a support, at a portion on which exposure light (image exposure light) impinges, out of the charges generated in the charge generation layer, a hole must be injected into the hole transport layer and an electron must be passed to the support. However, when an electron resides in the charge generation layer or in a layer interposed between the charge generation layer and the support and/or at an interface between them, a hole is apt to be injected from the support into the charge generation layer at the time of next charging, which is responsible for a positive ghost.

In addition, the residing electron affects sensitivity at the time of exposure (image exposure) after the next charging, so the sensitivity increases or decreases. This is responsible for a negative ghost or a positive ghost. In particular, the influence on the sensitivity is remarkable at an initial stage (first sheet).

Those causes conspire to cause a ghost phenomenon, which may manifest itself as a positive ghost or a negative ghost. Therefore, an electrophotographic photosensitive member satisfying both the provisions of the expressions (I) and (II) is expected to successfully suppress the ghost phenomenon through endurance from the initial stage (first sheet).

In addition, out of the electrophotographic photosensitive members each satisfying both the provisions of the expressions (I) and (II), an electrophotographic photosensitive member having m in the following approximate expression (III), which is composed of $V_X$, $V_{AX}$, and $V_{BX}$ defined as described later, the thickness d in units of μm of the hole transport layer, and constants m and n, in the range of $1\times10^{-4}$ to $2\times10^{-3}$ for $-200 \leqq V_X \leqq -120$ is preferable.

$$(|-600-V_{AX}|-|-600-V_{BX}|)/d=m\cdot V_X+n \quad \text{(III)}$$

$V_X$ and $V_{AX}$ $V_{AX}$ in units of volts represents a surface potential of an electrophotographic photosensitive member obtained by: rotating the electrophotographic photosensitive member 5 times while charging the surface of the electrophotographic photosensitive member by means of a charging device set to the charging condition $C_1$ to set the surface potential of the electrophotographic photosensitive member to −600 V; irradiating the surface of the electrophotographic photosensitive member having a surface potential of −600 V with light to set the surface potential of the electrophotographic photosensitive member to $V_X$ in units of volts; and charging the surface of the electrophotographic photosensitive member having a surface potential of $V_X$ in units of volts by means of the charging device set to the charging condition $C_1$.

$V_X$ and $V_{BX}$ $V_{BX}$ in units of volts represents a surface potential of the electrophotographic photosensitive member obtained by: rotating the electrophotographic photosensitive member 5 times while charging the surface of the electrophotographic photosensitive member by means of a charging device set to a predetermined charging condition $C_{2X}$ to set the surface potential of the electrophotographic photosensitive member to $V_X$ in units of volts; and charging the surface of the electrophotographic photosensitive member having a surface potential of $V_X$ in units of volts by means of a charging device set to the same condition as the charging condition $C_1$.

It should be noted that "$V_X$" in the above section "$V_X$ and $V_{AX}$" and "$V_X$" in the above section "$V_X$ and $V_{BX}$" have the same value.

Hereinafter, the charging condition $C_{2X}$ will be described. The charging condition is also determined prior to the determination as to whether the electrophotographic photosensitive member satisfies the provisions of the present invention.

Charging condition $C_{2X}$

The charging condition $C_{2X}$ is defined in the same manner as in each of the charging conditions $C_1$, $C_2$, and $C_3$ except that the value of the direct voltage out of the voltages applied to the charging roller is adjusted in such a manner that the surface potential of the electrophotographic photosensitive member to be judged will be $V_X$ in units of volts as a result of 5-rotation charging of the surface of the electrophotographic photosensitive member.

Satisfying the provision of the expression (III) allows a suppressing effect on a ghost phenomenon to be maintained for an extended period of time and causes a ghost at an initial stage (first sheet) at a reduced frequency.

The inventors of the present invention consider that, when m in the expression (III) is equal to or less than $2\times10^{-3}$, the amount of electrons residing in the charge generation layer or in a layer interposed between the charge generation layer and the support and/or at an interface between them is saturated, so a ghost phenomenon does not progress owing to durable use. However, when m in the expression (III) is less than $1\times10^{-4}$, a very slight negative ghost may occur at an initial stage (first sheet).

Figure 6:
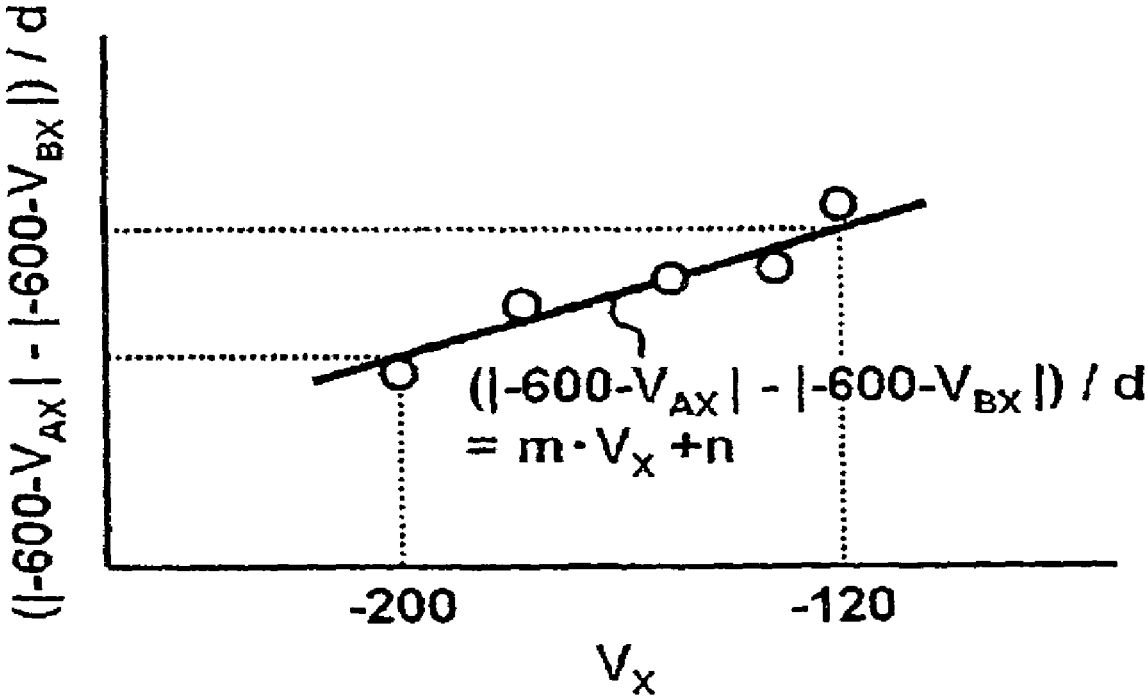
FIG. 6 is a graph showing a relationship between $V_X$ and $(|-600-V_{AX}|-|-600-V_{BX}|)/d$.

FIG. 6 shows an example of a graph showing a relationship between $V_X$ and $(|-600-V_{AX}|-|-600-V_{BX}|)/d$. The approximate expression (III) is derived by using a least-square method.

Next, the configuration of the electrophotographic photosensitive member of the present invention will be described.

As described above, the electrophotographic photosensitive member of the present invention is an electrophotographic photosensitive member, comprising: a support; a charge generation layer containing a charge generation substance, the charge generation layer being placed on the support; and a hole transport layer containing a hole transport substance, the hole transport layer being placed on the charge generation layer.

The support has only to be conductive (conductive support), and examples of an available support include metal (alloy-made) supports made of aluminum, nickel, copper, gold, iron, an aluminum alloy, stainless steel, and the like. Each of the metal supports having a layer composed of a coating film formed by vacuum deposition of aluminum, an aluminum alloy, an indium oxide-tin oxide alloy, or the like, a support made of a plastic (such as a polyester resin, a polycarbonate resin, or a polyimide resin), or a support made of glass may also be used. A support obtained by immersing a conductive particle such as carbon black, a tin oxide particle, a titanium oxide particle, or a silver particle with suitable binder resin into a plastic or paper, a support made of a plastic and having a conductive binder resin, or the like may also be used. Examples of the shape of the support include a cylindrical shape and a belt shape. Of those, a cylindrical shape is preferable.

In addition, the surface of the support may be subjected to cutting treatment, surface roughening treatment (such as honing treatment or blast treatment), alumite treatment, or the like for the purpose of preventing an interference fringe from occurring owing to the scattering of laser light or the like and for other purposes. Alternatively, the surface of the support may be chemically treated with a solution prepared by dissolving a metal salt compound or a metal salt of a fluorine compound into an acidic aqueous solution mainly composed of an alkali phosphate, phosphoric acid, or tannic acid.

The honing treatment is classified into dry honing treatment and wet honing treatment. The wet honing treatment is a method involving: suspending a levigated abrasive into a liquid such as water; and spraying the suspension to the surface of a support at a high speed to roughen the surface of the support. The surface roughness can be controlled by, for example, a spraying pressure, a spraying speed, the amount, kind, shape, size, hardness, specific gravity, and suspension temperature of the abrasive. The dry honing treatment is a method involving spraying an abrasive to the surface of a support at a high speed to roughen the surface of the support. The surface roughness can be controlled in the same manner as in the dry honing treatment. Examples of an abrasive used for the honing treatment include particles such as silicon carbide, alumina, iron, and glass beads.

A conductive layer may be interposed between the support and the charge generation layer or an intermediate layer to be described later for the purpose of preventing an interference fringe from occurring owing to the scattering of laser light or the like or for the purpose of covering a flaw on the support.

The conductive layer can be formed by dispersing conductive particles such as carbon black, metal particles, and metal oxide particles into a binder resin. Preferable examples of the metal oxide particles include particles of zinc oxide and titanium oxide. Particles of barium sulfate may also be used as the conductive particles. Each of the conductive particles may be provided with a coating layer.

Each of the conductive particles has a volume resistivity in the range of preferably 0.1 to 1,000 Ω·cm, particularly preferably 1 to 1,000 Ω·cm (The volume resistivity is measured by means of a resistance measuring device Loresta AP manufactured by Mitsubishi Chemical Corporation. A measurement sample is applied with a pressure of 49 MPa to have a coin shape.). In addition, the average particle size of the conductive particles is in the range of preferably 0.05 to 1.0 μm, particularly preferably 0.07 to 0.7 μm (The average particle size is measured by means of centrifugal sedimentation.). The ratio of the conductive particles in the conductive layer is in the range of preferably 1.0 to 90 mass %, particularly preferably 5.0 to 80 mass % with respect to the total mass of the conductive layer.

Examples of the binder resin to be used in the conductive layer include a phenol resin, a polyurethane resin, a polyamide resin, a polyimide resin, a polyamideimide resin, a polyamic acid resin, a polyvinyl acetal resin, an epoxy resin, an acrylic resin, a melamine resin, and a polyester resin. Each of those resins may be used alone, or two or more of them may be used as a mixture or a copolymer. Each of those resins has good adhesiveness with the support, increases the dispersability of the conductive particles, and has good solvent resistance after film formation. Of those, a phenol resin, a polyurethane resin, and a polyamic acid resin are preferable.

The conductive layer has a thickness in the range of preferably 0.1 to 30 μm, particularly preferably 0.5 to 20 μm.

The volume resistivity of the conductive layer is preferably equal to or lower than $10^{13}$ Ω·cm, particularly preferably in the range of $10^{5}$ to $10^{12}$ Ω·cm (The volume resistivity is determined by: forming a coating film on an aluminum plate by using the same material as that for the conductive layer to be measured; forming a gold thin film on the coating film; and measuring the value of a current flowing between both electrodes of the aluminum plate and the gold thin film by means of a pA meter.).

In addition, the conductive layer may contain fluorine or antimony as required, or may be added with a leveling agent for increasing the surface property of the conductive layer.

In addition, an intermediate layer having a barrier function or an adhesion function (also referred to as an underlying layer or an adhesive layer) may be interposed between the support or the conductive layer and the charge generation layer. The intermediate layer is formed for improving the adhesiveness of the photosensitive layer, coatability, and property of injecting a charge from the support, for protecting the photosensitive layer against electrical breakdown, and for other purposes.

The intermediate layer can be formed of: a resin such as an acrylic resin, an allyl resin, an alkyd resin, an ethylcellulose resin, an ethylene-acrylic copolymer, an epoxy resin, a casein resin, a silicone resin, a gelatin resin, nylon, a phenol resin, a butyral resin, a polyacrylate resin, a polyacetal resin, a polyamideimide resin, a polyamide resin, a polyallylether resin, a polyimide resin, a polyurethane resin, a polyester resin, a polyethylene resin, a polycarbonate resin, a polystyrene resin, a polysulfone resin, a polyvinylalcohol resin, a polybutadiene resin, a polypropylene resin, or a urea resin; or a material such as aluminum oxide.

The intermediate layer has a thickness in the range of preferably 0.05 to 5 μm, particularly preferably 0.3 to 1 μm.

Examples of the charge generation substance to be used in the electrophotographic photosensitive member of the present invention include: azo pigments such as monoazo, disazo, and trisazo pigments; phthalocyanine pigments such as metal phthalocyanine and non-metal phthalocyanine pigments; indigo pigments such as indigo and thioindigo pigments; perylene pigments such as perylenic anhydride and perylenic imide; polycyclic quinone pigments such as anthraquinone and pyrenequinone pigments; squarium dyestuffs; pyrylium salts and thiapyrylium salts; triphenylmethane dyestuffs; inorganic substances such as selenium, selenium-tellurium, and amorphous silicon; quinacridone pigments; azulenium salt pigments; cyanine dyes; xanthene dyestuffs; quinoneimine dyestuffs; styryl dyestuffs; cadmium sulfide; and zinc oxide. Each of those charge generation substances may be used alone, or two or more of them may be used in combination.

Of the above various charge generation substance, the azo pigments and the phthalocyanine pigments are preferable because they have high sensitivity but are apt to cause ghost phenomena, so the present invention acts more effectively, and the phthalocyanine pigments are particularly preferable.

Of the phthalocyanine pigments, the metal phthalocyanine pigments are preferable. Of the metal phthalocyanine pigments, oxytitanium phthalocyanine, chlorogallium phthalocyanine, dichlorotin phthalocyanine, and hydroxygallium phthalocyanine are preferable, and hydroxygallium phthalocyanine is particularly preferable.

Preferable as oxytitanium phthalocyanine is an oxytitanium phthalocyanine crystal of a crystal form having strong peaks at Bragg angles 2θ±0.2° in CuKα characteristic X-ray diffraction of 9.0°, 14.2°, 23.9°, and 27.1° or an oxytitanium phthalocyanine crystal of a crystal form having strong peaks at Bragg angles 2θ±0.2° in CuKα characteristic X-ray diffraction of 9.5°, 9.7°, 11.7°, 15.0°, 23.5°, 24.1°, and 27.3°.

Preferable as chlorogallium phthalocyanine is a chlorogallium phthalocyanine crystal of a crystal form having strong peaks at Bragg angles 2θ±0.2° in CuKα characteristic X-ray diffraction of 7.4°, 16.6°, 25.5°, and 28.2°, a chlorogallium phthalocyanine crystal of a crystal form having strong peaks at Bragg angles 2θ±0.2° in CuKα characteristic X-ray diffraction of 6.8°, 17.3°, 23.6°, and 26.9°, or a chlorogallium phthalocyanine crystal of a crystal form having strong peaks at Bragg angles 2θ±0.2° in CuKα characteristic X-ray diffraction of 8.7 to 9.2°, 17.6°, 24.0°, 27.4°, and 28.8°.

Preferable as dichlorotin phthalocyanine is a dichlorotin phthalocyanine crystal of a crystal form having strong peaks at Bragg angles 2θ±0.2° in CuKα characteristic X-ray diffraction of 8.3°, 12.2°, 13.7°, 15.9°, 18.9°, and 28.2°, a dichlorotin phthalocyanine crystal of a crystal form having strong peaks at Bragg angles 2θ±0.2° in CuKα characteristic X-ray diffraction of 8.5°, 11.2°, 14.5°, and 27.2°, a dichlorotin phthalocyanine crystal of a crystal form having strong peaks at Bragg angles 2θ±0.2° in CuKα characteristic X-ray diffraction of 8.7°, 9.9°, 10.9°, 13.1°, 15.2°, 16.3°, 17.4°, 21.9°, and 25.5°, or a dichlorotin phthalocyanine crystal of a crystal form having strong peaks at Bragg angles 2θ±0.2° in CuKα characteristic X-ray diffraction of 9.2°, 12.2°, 13.4°, 14.6°, 17.0°, and 25.3°.

Preferable as hydroxygallium phthalocyanine is a hydroxygallium phthalocyanine crystal of a crystal form having strong peaks at Bragg angles 2θ±0.2° in CuKα characteristic X-ray diffraction of 7.3°, 24.9°, and 28.1° or a hydroxygallium phthalocyanine crystal of a crystal form having strong peaks at Bragg angles 2θ±0.2° in CuKα characteristic X-ray diffraction of 7.5°, 9.9°, 12.5°, 16.3°, 18.6°, 25.1°, and 28.3°.

The particle size of the charge generation substance is preferably equal to or less than 0.5 μm, more preferably equal to or less than 0.3 μm, still more preferably in the range of 0.01 to 0.2 μm.

Examples of the binder resin to be used in the charge generation layer include an acrylic resin, an allyl resin, an alkyd resin, an epoxy resin, a diallylphthalate resin, a silicone resin, a styrene-butadiene copolymer, a cellulose resin, nylon, a phenol resin, a butyral resin, a benzal resin, a melamine resin, a polyacrylate resin, a polyacetal resin, a polyamideimide resin, a polyamide resin, a polyallylether resin, a polyallylate resin, a polyimide resin, a polyurethane resin, a polyester resin, a polyethylene resin, a polycarbonate resin, a polystyrene resin, a polysulfone resin, a polyvinyl acetal resin, a polyvinyl methacrylate resin, a polyvinyl acrylate resin, a polybutadiene resin, a polypropylene resin, a methacrylic resin, a urea resin, a vinyl chloride-vinyl acetate copolymer, a vinyl acetate resin, and a vinyl chloride resin. Of those, a butyral resin or the like is particularly preferable. Each of those resins may be used alone, or two or more of them may be used as a mixture or a copolymer.

A method involving incorporating an electron transport substance into the charge generation layer can be exemplified as one method of producing an electrophotographic photosensitive member satisfying the provisions of the expressions (I), (II), and (III).

Examples of the electron transport substance include: fluorenone compounds such as trinitrofluorenone; imide compounds such as pyromellitic imide and naphthylimide; quinone compounds such as benzoquinone, diphenoquinone, diiminoquinone, naphthoquinone, stilbenzoquinone, and anthraquinone; fluorenylidene compounds such as fluorenylidene aniline and fluorenylidene malononitrile; carboxylic anhydrides such as phthalic anhydride; cyclic sulfone compounds such as thiopyran dioxide; oxadiazole compounds; and triazole compounds. Of those, the imide compounds are preferable, and a naphthalene tetracarboxylic acid diimide compound having a structure represented by the following formula (1) is particularly preferable.

[Compound 1]

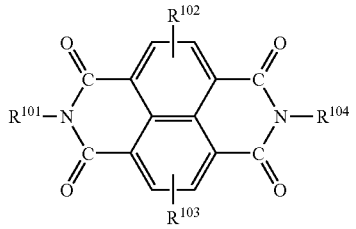

(1)

In the formula (1), $R^{101}$ and $R^{104}$ each independently represent a substituted or unsubstituted alkyl group, a substituted or unsubstituted alkyl group interrupted by an ether group, a substituted or unsubstituted alkenyl group, a substituted or unsubstituted alkenyl group interrupted by an ether group, a substituted or unsubstituted aryl group, a substituted or unsubstituted aralkyl group, or a monovalent and substituted or unsubstituted heterocyclic group. $R^{102}$ and $R^{103}$ each independently represent a hydrogen atom, a halogen atom, a nitro group, a substituted or unsubstituted alkyl group, or a substituted or unsubstituted alkoxy group.

Examples of the alkyl group include: chain alkyl groups such as a methyl group, an ethyl group, and a propyl group; and cyclic alkyl groups such as a cyclohexyl group and a cycloheptyl group. Examples of the alkenyl group include a vinyl group and an allyl group. Examples of the aryl group include a phenyl group, a naphthyl group, and an anthryl group. Examples of the aralkyl group include a benzyl group and a phenethyl group. Examples of the monovalent heterocyclic group include a pyridyl group and a fural group. Examples of the halogen atom include a fluorine atom, a chlorine atom, and a bromine atom. Examples of the alkoxy group include a methoxy group, an ethoxy group, and a propoxy group.

Examples of a substituent which each of the above groups may have include: an alkyl group such as a methyl group, an ethyl group, a propyl group, a cyclohexyl group, or a cycloheptyl group; an alkenyl group such as a vinyl group or an allyl group; a nitro group; a halogen atom such as a fluorine atom, a chlorine atom, or a bromine atom; a halogenated alkyl group such as a perfluoroalkyl group; an aryl group such as a phenyl group, a naphthyl group, or an anthryl group; an aralkyl group such as a benzyl group or a phenethyl group; and an alkoxy group such as a methoxy group, an ethoxy group, or a propoxy group.

In the naphthalene tetracarboxylic acid diimide compound having the structure represented by the formula (1), at least one of $R^{101}$ and $R^{104}$ preferably represents a substituted or unsubstituted and chain alkyl group or a substituted aryl group. In addition, out of the substituted or unsubstituted and chain alkyl groups, a chain alkyl group substituted by a halogen atom is preferable. Of the substituted aryl groups, an aryl group substituted by a halogen atom, an aryl group substituted by an alkyl group, or an aryl group substituted by a halogenated alkyl group is preferable. In addition, the naphthalene tetracarboxylic acid diimide compound having the structure represented by the formula (1) is preferably of an asymmetric structure (for example, $R^{101}$ and $R^{104}$ represent different groups) from the viewpoint of solubility in a solvent.

An electron transport substance to be incorporated into the charge generation layer has a reduction potential (a reduction potential by a saturated calomel electrode) in the range of preferably −0.80 to 0.00 V, more preferably −0.65 to −0 25 V and still more preferably −0.60 to −0.25 V.

Specific examples of the naphthalene tetracarboxylic acid diimide compound having the structure represented by the formula (1) will be shown below, but the present invention is not limited to these examples.

[Compound 2]

(1-1)

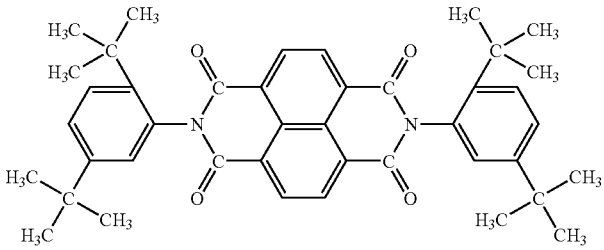

(1-2)

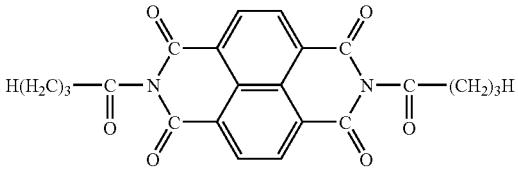

(1-3)

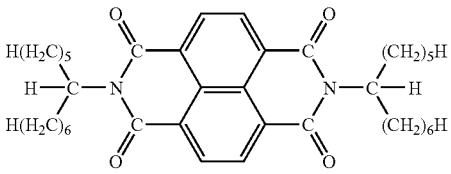

-continued
(1-4)
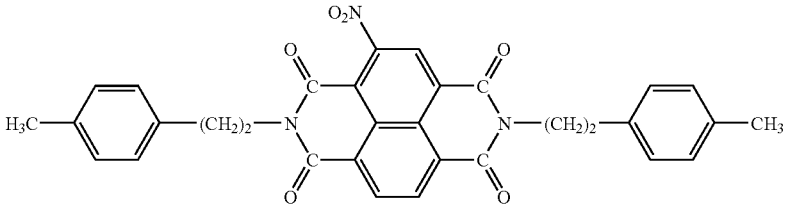
(1-5)
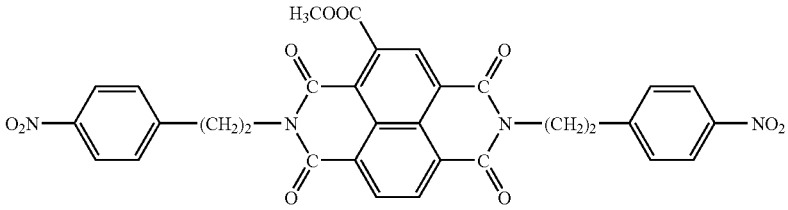
[Compound 3]
(1-6)
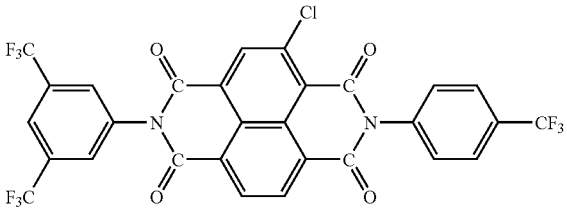
(1-7)
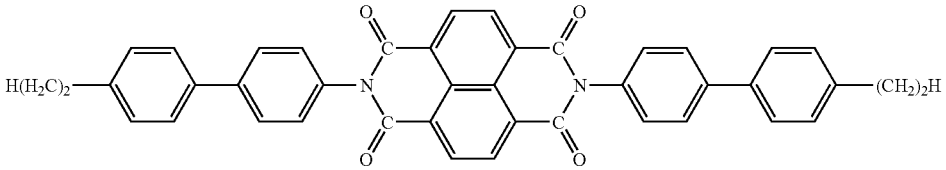
(1-8)
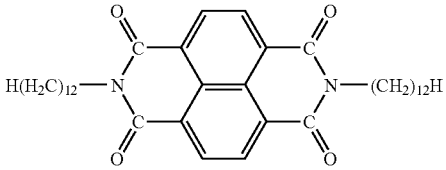
(1-9)
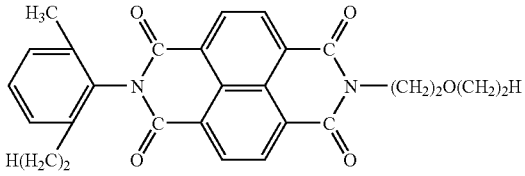
(1-10)
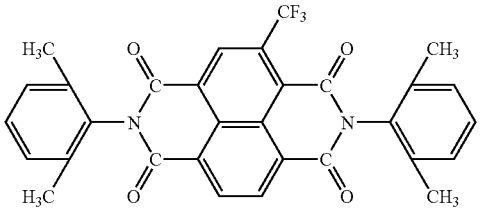
[Compound 4]

-continued (1-11)

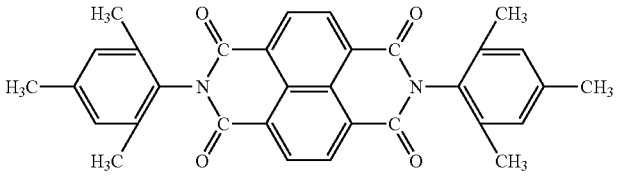

(1-12)

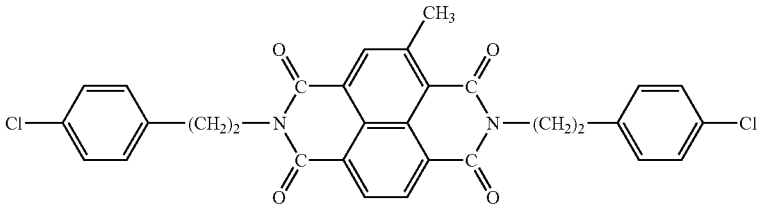

(1-13)

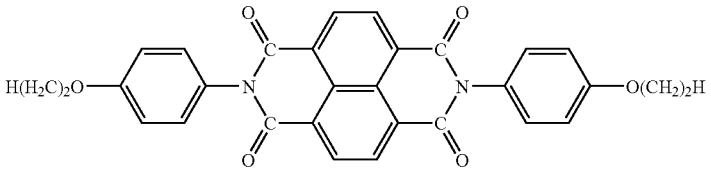

The reduction potentials of the naphthalene tetracarboxylic acid diimide compounds having the structures represented by the formulae (1-1) to (1-13) are as follows.

−0.59 V (1-1):

−0.51 V (1-2):

−0.58 V (1-3):

−0.46 V (1-4):

−0.48 V (1-5):

−0.47 V (1-6):

−0.58 V (1-7):

−0.58 V (1-8):

−0.57 V (1-9):

−0.49 V (1-10):

−0.59 V (1-11):

−0.45 V (1-12):

−0.59 V (1-13):

The ratio of the electron transport substance in the charge generation layer is in the range of preferably 10 to 60 mass %, particularly preferably 21 to 40 mass % with respect to the charge generation substance in the charge generation layer.

The charge generation layer can be formed by: applying an application liquid for a charge generation layer obtained by dispersing a charge generation substance and, if necessary, an electron transport substance together with a binder resin and a solvent; and drying the applied liquid. Examples of a dispersing method include methods using a homogenizer, an ultrasonic dispersing device, a ball mill, a sand mill, a roll mill, a vibration mill, an atliter, a liquid-colliding high speed dispersing device, and the like. A ratio between the charge generation substance and the binder resin is preferably in the range of 1:0.5 to 1:4 (mass ratio).

The solvent to be used for the application liquid for a charge generation layer is selected in consideration of the solubility and dispersion stability of each of the binder resin and the charge generation substance to be used. Examples of an organic solvent include an alcohol, a sulfoxide, a ketone, an ether, an ester, an aliphatic halogenated hydrocarbon, and an aromatic compound.

The charge generation layer has a thickness of preferably 5 μm or less, more preferably 0.01 to 2 μm, still more preferably 0.05 to 0.3 μm.

Any one of various sensitizers, antioxidants, ultraviolet absorbers, plasticizers, and the like may be added as required to the charge generation layer.

Examples of the hole transport substance to be used in the electrophotographic photosensitive member of the present invention include a triarylamine compound, a hydrazone compound, a styryl compound, a stilbene compound, a pyrazoline compound, an oxazole compound, a thiazole compound, and a triarylmethane compound. Each of those hole transport substances may be used alone, or two or more of them may be used in combination.

Examples of a binder resin to be used in a hole transport layer include an acrylic resin, an acrylonitrile resin, an allyl resin, an alkyd resin, an epoxy resin, a silicone resin, nylon, a phenol resin, a phenoxy resin, a butyral resin, a polyacrylamide resin, a polyacetal resin, a polyamideimide resin, a polyamide resin, a polyallylether resin, a polyallylate resin, a polyimide resin, a polyurethane resin, a polyester resin, a polyethylene resin, a polycarbonate resin, a polystyrene resin, a polysulfone resin, a polyvinyl butyral resin, a polyphenyleneoxide resin, a polybutadiene resin, a polypropylene resin, a methacrylic resin, a urea resin, a vinyl chloride resin, and a vinyl acetate resin. Of those, a polyallylate resin and a polycarbonate resin are preferable. Each of those resins may be used alone, or two or more of them may be used as a mixture or a copolymer.

The hole transport layer can be formed by: applying an application liquid for a hole transport layer obtained by dissolving a hole transport substance and a binder resin into a solvent; and drying the applied liquid. The ratio between the hole transport substance and the binder resin is preferably in the range of 2:1 to 1:2 (mass ratio).

Examples of the solvent to be used for the application liquid for a hole transport layer include: ketones such as acetone and methyl ethyl ketone; esters such as methyl acetate and ethyl acetate; aromatic hydrocarbons such as toluene and xylene; ethers such as 1,4-dioxane and tetrahydrofuran; and hydrocarbons substituted by halogen atoms such as chlorobenzene, chloroform, and carbon tetrachloride.

The hole transport layer has a thickness in the range of preferably 1 to 50 μm, particularly preferably 3 to 30 μm.

In addition, an antioxidant, an ultraviolet absorber, a plasticizer, or the like may be added as required to the hole transport layer.

A protective layer may be placed on a hole transport layer for the purpose of protecting the hole transport layer. The protective layer can be formed by: applying an application liquid for a protective layer obtained by dissolving a binder resin into a solvent; and drying the applied liquid. The protective layer can also be formed by: applying an application liquid for a protective layer obtained by dispersing a monomer/oligomer of a binder resin into a solvent; and curing and/or drying the applied liquid. Light, heat, or a radial ray (such as an electron beam) may be used for the curing.

Each of the above various resins can be used as the binder resin for the protective layer.

The protective layer has a thickness in the range of preferably 0.5 to 10 μm, particularly preferably 1 to 5 μm.

In applying the application liquids for the above respective layers, coating methods such as a dip coating method, a spray coating method, a spinner coating method, a roller coating method, a meier bar coating method, and a blade coating method can be used.

Figure 7:
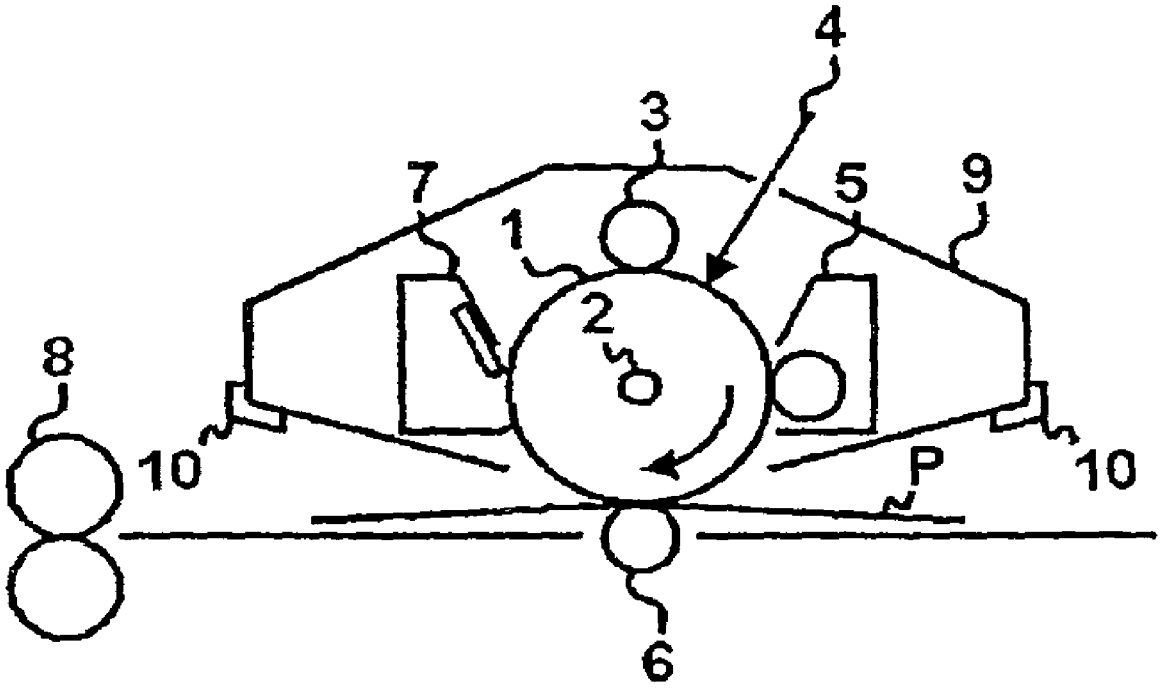
FIG. 7 is a schematic drawing showing an example of a schematic configuration of an electrophotographic apparatus equipped with a process cartridge having an electrophotographic photosensitive member of the present invention.

FIG. 7 shows an example of a schematic configuration of an electrophotographic apparatus equipped with a process cartridge having an electrophotographic photosensitive member of the present invention.

In FIG. 7, reference numeral 1 denotes a cylindrical electrophotographic photosensitive member, which is rotationally driven in an arrow direction around an axis 2 at a predetermined peripheral speed.

The surface of the electrophotographic photosensitive member 1 to be rotationally driven is uniformly charged up to a positive or negative predetermined electric potential by charging means (primary charging means: a charging roller or the like) 3, and then receives exposure light (image exposure light) 4 outputted from exposing means (not shown) such as slit exposure or laser beam scanning exposure. Thus, electrostatic latent images each corresponding to a target image are sequentially formed on the surface of the electrophotographic photosensitive member 1.

The electrostatic latent images formed on the surface of the electrophotographic photosensitive member 1 are developed with toner in a developer of developing means 5 to become toner images. Next, the toner images formed and carried on the surface of the electrophotographic photosensitive member 1 are sequentially transferred by virtue of a transferring bias from transferring means (such as a transferring roller) 6 onto a transfer material (such as paper) P fed from transfer material supplying means (not shown) into a space (abutment portion) between the electrophotographic photosensitive member 1 and the transferring means 6 in synchronization with the rotation of the electrophotographic photosensitive member 1.

The transfer material P onto which the toner images have been transferred is separated from the surface of the electrophotographic photosensitive member 1 and introduced into fixing means 8 to receive an image fixation operation. Then, the resultant fixed transfer material P is printed out as an image formed product (print or copy) to the outside of the apparatus.

The surface of the electrophotographic photosensitive member 1 after the transfer of the toner images undergoes removal of the transfer residual developer (toner) by cleaning means (such as a cleaning blade) 7 to be cleansed. Furthermore, the surface is subjected to electrostatic removal treatment by pre-exposure light (not shown) from pre-exposing means (not shown), and is then repeatedly used for image formation. Pre-exposure is not necessarily needed in the case where the charging means 3 is contact charging means using a charging roller or the like as shown in FIG. 7.

Two or more of the components such as the electrophotographic photosensitive member 1, the charging means 3, the developing means 5, the transferring means 6, and the cleaning means 7 described above may be stored in a container and integrally connected to constitute a process cartridge, and the process cartridge may be designed to be detachably attached to the main body of an electrophotographic apparatus such as a copying machine or a laser beam printer. In FIG. 7, the electrophotographic photosensitive member 1, the charging means 3, the developing means 5, and the cleaning means 7 are integrally supported to provide a process cartridge 9 that is detachably attached to the main body of the electrophotographic apparatus by means of guiding means 10 such as a rail of the main body.

Figure 8:
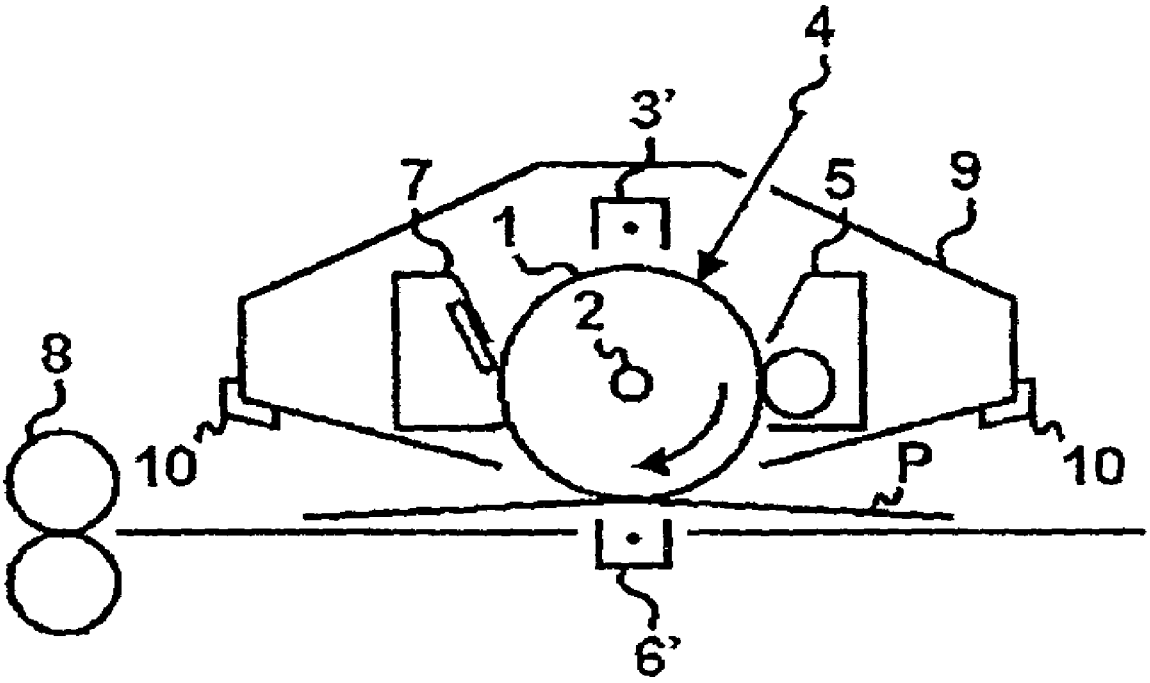
FIG. 8 is a schematic drawing showing another example of the schematic configuration of the electrophotographic apparatus equipped with the process cartridge having the electrophotographic photosensitive member of the present invention.

FIG. 8 shows another example of the schematic configuration of the electrophotographic apparatus equipped with the process cartridge having the electrophotographic photosensitive member of the present invention.

The electrophotographic apparatus having the configuration shown in FIG. 8 has charging means 3' using a corona discharger and transferring means 6' using a corona discharger. The operation of the apparatus is the same as that of the electrophotographic apparatus having the configuration shown in FIG. 7.

EXAMPLES

Hereinafter, the present invention will be described in more detail by way of specific examples. However, the present invention is not limited to these examples. The term "part" in the examples means "part by mass".

Example 1

The surface of an aluminum cylinder having a diameter of 30 mm and a length of 260.5 mm was subjected to wet honing treatment and ultrasonic water washing, and the resultant was provided as a support.

Next, 5 parts of N-methoxymethylated nylon 6 were dissolved into 95 parts of methanol to prepare an application liquid for an intermediate layer.

The application liquid for an intermediate layer was applied onto the support by means of dip coating and dried for 20 minutes at 100° C. to form an intermediate layer having a thickness of 0.5 μm.

Next, 10 parts of a hydroxygallium phthalocyanine crystal of a crystal form (charge generation substance) having strong peaks at Bragg angles 2θ±0.2° in CuKα characteristic X-ray diffraction of 7.5°, 9.9°, 12.5°, 16.3°, 18.6°, 25.1°, and 28.3°, 0.1 part of a compound having a structure represented by the following formula (2),

[Compound 5]

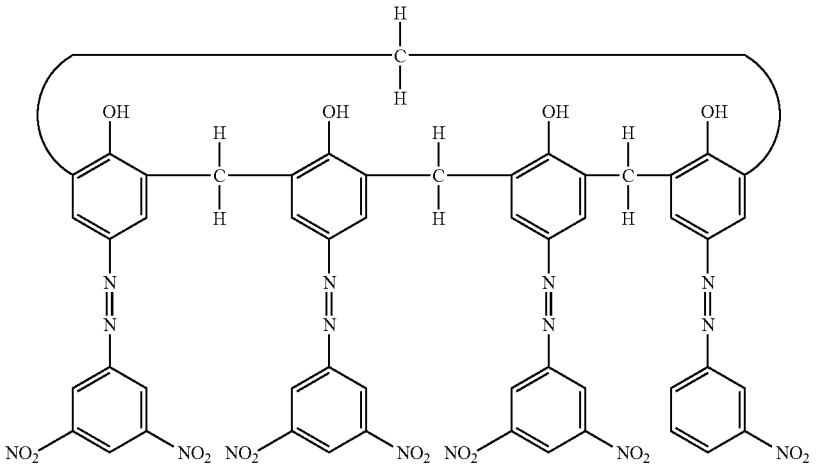

(2)

5 parts of a polyvinyl butyral resin (trade name: S-LEC BX-1, manufactured by Sekisui Chemical Co., Ltd.), and 250 parts of cyclohexanone were dispersed by using a sand mill device using glass beads each having a diameter of 1 mm for 4 hours. Then, 3 parts of a compound having a structure represented by the following formula (3) (electron transport substance, reduction potential: −0.47 V)

[Compound 6]

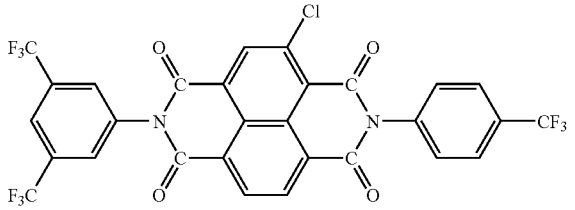

(3)

were dissolved into the dispersion. After that, 250 parts of butyl acetate were added to the resultant to prepare an application liquid for a charge generation layer.

The application liquid for a charge generation layer was applied onto the intermediate layer by means of dip coating and dried for 10 minutes at 100° C. to form a charge generation layer having a thickness of 0.16 μm.

Next, 10 parts of a compound having a structure represented by the following formula (4) (hole transport substance)

[Compound 7]

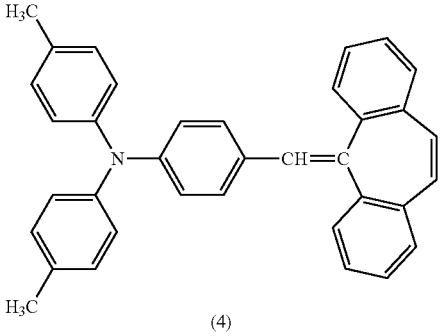

(4)

and 10 parts of a polyallylate resin having a repeating structural unit represented by the following formula (5) (weight average molecular weight: 115,000, molar ratio between a terephthalic acid skeleton and an isophthalic acid skeleton: terephthalic acid skeleton/isophthalic acid skeleton=50/50)

[Compound 8]

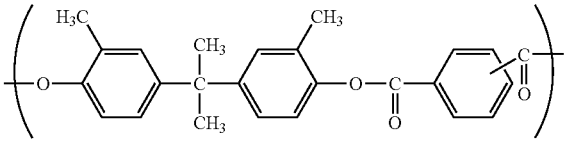

(5)

were dissolved into a mixed solvent of 50 parts of monochlorobenzene/30 parts of dichloromethane to prepare an application liquid for a hole transport layer.

The application liquid for a hole transport layer was applied onto the charge generation layer by means of dip coating and dried for 1 hour at 120° C. to form a hole transport layer having a thickness of 17 μm.

Thus, an electrophotographic photosensitive member which had the support, which had the intermediate layer, the charge generation layer, and the hole transport layer laminated in this order on the support, and in which the hole transport layer was a surface layer was produced.

Parameters relating to the expressions (I) to (III) of the produced electrophotographic photosensitive member were determined as described above. Table 1 shows the values.

The produced electrophotographic photosensitive member was mounted on the following evaluation apparatus. Then, image output was performed under the conditions including a dark area potential of −600 V and a light area potential of −150 V, and an output image was evaluated.

Evaluation Apparatus

The evaluation apparatus used in Example 1 was a remodeled device of a laser beam printer "Color Laser Jet 4600" manufactured by Hewlett-Packard Development Company (process speed: 94.2 mm/s) having no electrostatic removal means on each of an upstream side of charging means and a downstream side of transferring means in the direction of rotation of the electrophotographic apparatus. The charging means of the laser beam printer was contact charging means equipped with a charging roller, and a voltage composed only of a direct voltage was applied to the charging roller. The laser beam printer was remodeled, with the result that the quantity of light of exposure light (image exposure light) became variable.

Image pattern for evaluation

Figure 9:
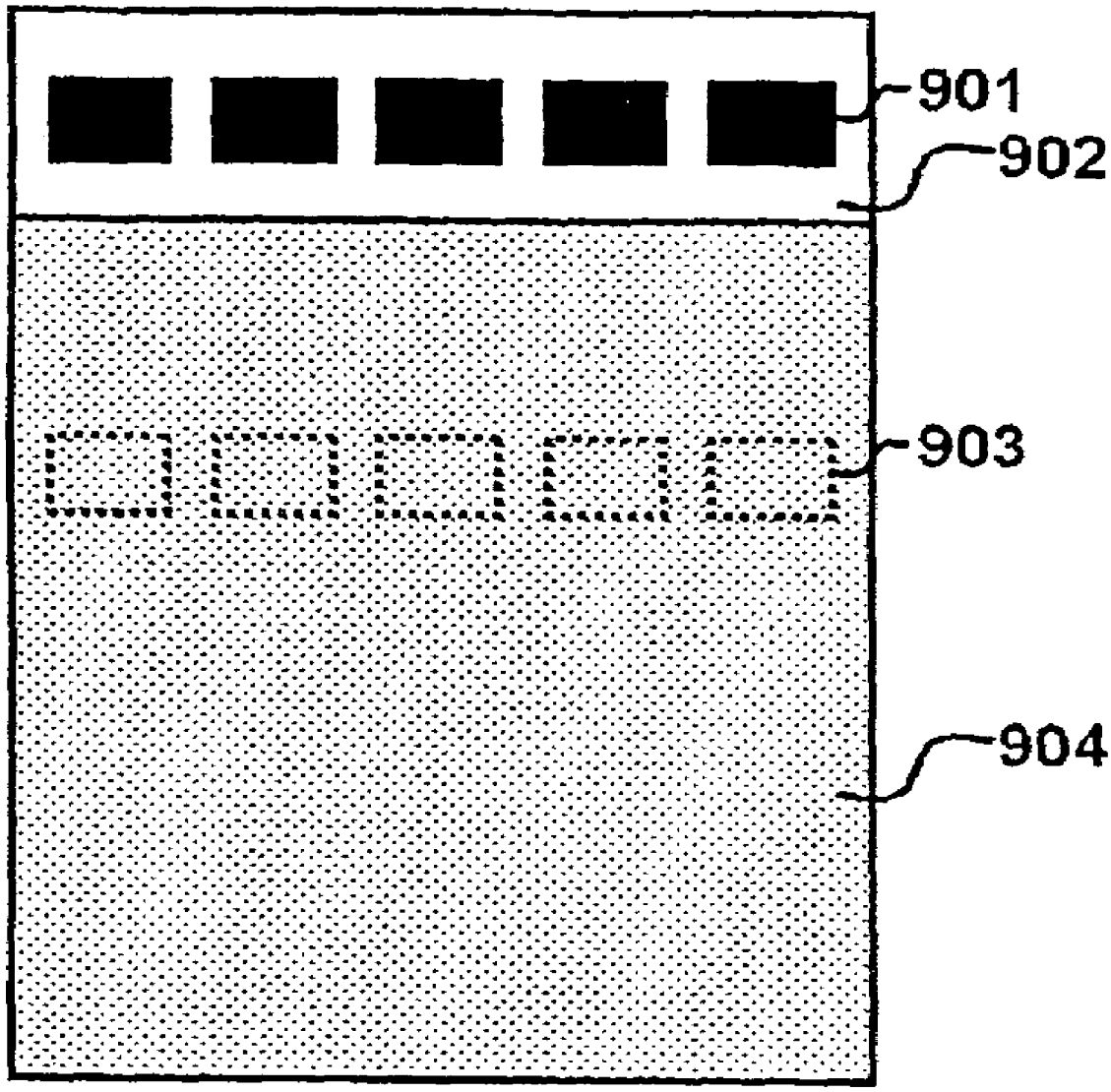
FIG. 9 shows an image pattern for evaluation.

Solid white and a pattern for a ghost shown in FIG. 9 were prepared as image patterns for evaluation. In FIG. 9, reference numeral 901 denotes a solid black portion (blackened rectangle); 902 denotes a solid white portion; 903 denotes a portion at which a ghost resulting from the solid black 901 can appear; and 904 denotes a halftone portion (one-dot knight-jump pattern).

Initial Evaluation

First, one sheet of a solid white image was outputted, and then 12 sheets of a pattern for a ghost were outputted. Out of the 12 sheets of the pattern for a ghost, the first sheet and the twelfth sheet were evaluated. The evaluation of a ghost was performed by using a spectro-densitometer X-Rite 504/508 manufactured by X-Rite. In the images of the pattern for a ghost, a density obtained by subtracting the density of the halftone portion 904 from the density of the portion 903 at which a ghost was able to appear was measured. The measurement was performed 10 times, and the average value of 10 measurements was determined. A positive sign (+) of a value corresponds to a positive ghost, while a negative sign (−) of a value corresponds to a negative ghost. Table 2 shows the results of the evaluation.

Evaluation After Endurance

After the initial evaluation, 10,000 sheets of an image having a density of 10% were outputted, and then the same evaluation as that described above was performed again. Table 2 shows the results of the evaluation.

Each of the initial evaluation and the evaluation after endurance was performed under 2 environments: a normal-temperature-and-normal-humidity environment (23° C., 50% RH) and a low-temperature-and-low-humidity environment (15° C., 10% RH).

Example 2

An electrophotographic photosensitive member was produced in the same manner as in Example 1 except that 3 parts of the compound having the structure represented by the formula (3) (electron transport substance) used in the charge generation layer were changed to 3 parts of a compound having a structure represented by the following formula (6) (electron transport substance, reduction potential: −0.49 V).

[Compound 9]

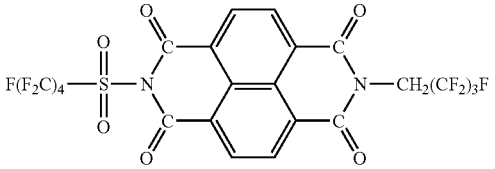

(6)

Parameters relating to the expressions (I) to (III) of the produced electrophotographic photosensitive member were determined as described above. Table 1 shows the values.

The produced electrophotographic photosensitive member was evaluated in the same manner as in Example 1. Table 2 shows the results of the evaluation.

Example 3

An electrophotographic photosensitive member was produced in the same manner as in Example 1 except that 3 parts of the compound having the structure represented by the formula (3) (electron transport substance) used in the charge generation layer were changed to 3 parts of a compound having a structure represented by the following formula (7) (electron transport substance, reduction potential: −0.51 V).

[Compound 10]

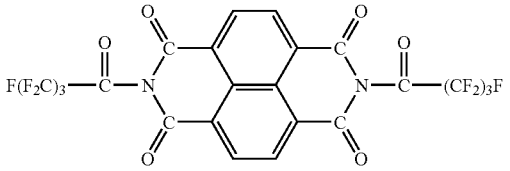

(7)

Parameters relating to the expressions (I) to (III) of the produced electrophotographic photosensitive member were determined as described above. Table 1 shows the values.

The produced electrophotographic photosensitive member was evaluated in the same manner as in Example 1. Table 2 shows the results of the evaluation.

Example 4

An electrophotographic photosensitive member was produced in the same manner as in Example 1.

Parameters relating to the expressions (I) to (III) of the produced electrophotographic photosensitive member were determined as described above. Table 1 shows the values.

Image output was performed under the conditions including a dark area potential of −600 V and a light area potential of −150 V in the same manner as in Example 1 except that the following evaluation apparatus was used as an evaluation apparatus on which the produced electrophotographic photosensitive member was mounted. Then, an output image was evaluated. Table 2 shows the results of the evaluation.

Evaluation Apparatus

The evaluation apparatus used in Example 4 was a remodeled device of a laser beam printer "Color Laser Jet 4600" manufactured by Hewlett-Packard Development Company (process speed: 94.2 mm/s) having no electrostatic removal means on each of an upstream side of charging means and a downstream side of transferring means. The laser beam printer was remodeled, with the result that the charging means was changed to corona charging means equipped with a corona discharger and the quantity of light of exposure light (image exposure light) became variable.

Example 5

An electrophotographic photosensitive member was produced in the same manner as in Example 2.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 6

An electrophotographic photosensitive member was produced in the same manner as in Example 3.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 7

An aluminum cylinder having a diameter of 30 mm and a length of 260.5 mm was provided as a support.

Next, 50 parts of titanium oxide particles coated with tin oxide containing 10 mass % antimony oxide, 25 parts of a resole-type phenol resin, 30 parts of methoxypropanol, 30 parts of methanol, and 0.002 part of silicone oil (polydimethylsiloxane polyoxyalkylene copolymer, weight average molecular weight: 3,000) were dispersed by using a sand mill device using glass beads each having a diameter of 1 mm for 2 hours to prepare an application liquid for a conductive layer.

The application liquid for a conductive layer was applied onto the support by means of dip coating and dried for 20 minutes at 140° C. to form a conductive layer having a thickness of 20 μm.

Next, 5 parts of N-methoxymethylated nylon 6 were dissolved into 95 parts of methanol to prepare an application liquid for an intermediate layer.

The application liquid for an intermediate layer was applied onto the conductive layer by means of dip coating and dried for 20 minutes at 100° C. to form an intermediate layer having a thickness of 0.5 μm.

Next, 10 parts of a hydroxygallium phthalocyanine crystal of a crystal form (charge generation substance) having strong peaks at Bragg angles 2θ±0.2° in CuKα characteristic X-ray diffraction of 7.5°, 9.9°, 12.5°, 16.3°, 18.6°, 25.1√, and 28.3°, 0.1 part of the compound having the structure represented by the formula (2), 5 parts of a polyvinyl butyral resin (trade name: S-LEC BX-1, manufactured by Sekisui Chemical Co., Ltd.), and 250 parts of cyclohexanone were dispersed by using a sand mill device using glass beads each having a diameter of 1 mm for 4 hours. Then, 3 parts of a compound having a structure represented by the following formula (8) (electron transport substance, reduction potential: −0.52 V).

[Compound 11]

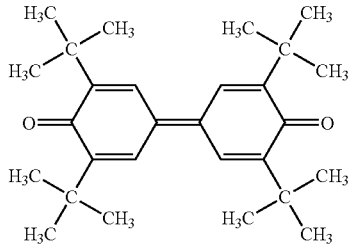

(8)

were dissolved into the dispersion. After that, 250 parts of butyl acetate were added to the resultant to prepare an application liquid for a charge generation layer.

The application liquid for a charge generation layer was applied onto the intermediate layer by means of dip coating and dried for 10 minutes at 100° C. to form a charge generation layer having a thickness of 0.16 μm.

Next, 10 parts of the compound having the structure represented by the formula (4) (hole transport substance) and 10 parts of a polycarbonate resin having a repeating structural unit represented by the following formula (9) (weight average molecular weight: 20,000)

[Compound 12]

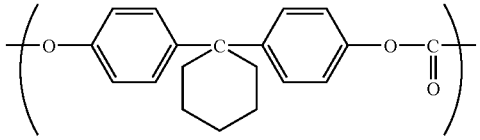

(9)

were dissolved into a mixed solvent of 50 parts of monochlorobenzene/30 parts of dichloromethane to prepare an application liquid for a hole transport layer.

The application liquid for a hole transport layer was applied onto the charge generation layer by means of dip coating and dried for 1 hour at 120° C. to form a hole transport layer having a thickness of 20 μm.

Thus, an electrophotographic photosensitive member which had the support, which had the conductive layer, the intermediate layer, the charge generation layer, and the hole transport layer laminated in this order on the support, and in which the hole transport layer was a surface layer was produced.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 8

An electrophotographic photosensitive member was produced in the same manner as in Example 7 except that 3 parts of the compound having the structure represented by the formula (8) (electron transport substance) used in the charge generation layer were changed to 3 parts of a compound having a structure represented by the following formula (10) (electron transport substance, reduction potential: −0.52 V).

[Compound 13]

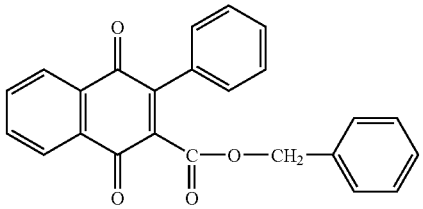

(10)

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 9

An electrophotographic photosensitive member was produced in the same manner as in Example 7 except that 3 parts of the compound having the structure represented by the formula (8) (electron transport substance) used in the charge generation layer were changed to 3 parts of a compound having a structure represented by the following formula (11) (electron transport substance, reduction potential: −0.25 V).

[Compound 14]

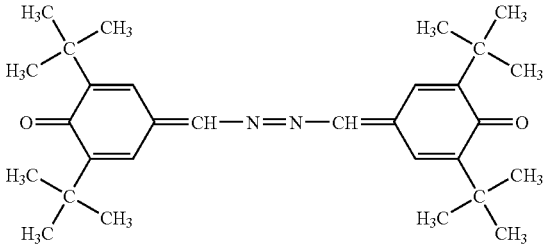

(11)

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 10

An electrophotographic photosensitive member was produced in the same manner as in Example 7 except that 3 parts of the compound having the structure represented by the formula (8) (electron transport substance) used in the charge generation layer were changed to 3 parts of a compound having a structure represented by the following formula (12) (electron transport substance, reduction potential: −0.54 V).

[Compound 15]

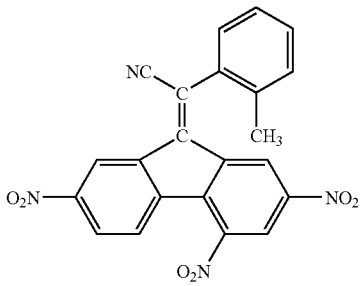

(12)

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 11

An electrophotographic photosensitive member was produced in the same manner as in Example 1 except that: the amount of the compound having the structure represented by the formula (3) (electron transport substance) used in the charge generation layer was changed from 3 parts to 2.5 parts; 10 parts of the polyallylate resin having the repeating structural unit represented by the formula (5) used in the hole transport layer were changed to 10 parts of the polycarbonate resin having the repeating structural unit represented by the formula (9); and the thickness of the hole transport layer was changed from 17 μm to 20 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 12

An electrophotographic photosensitive member was produced in the same manner as in Example 1 except that: the amount of the compound having the structure represented by the formula (3) (electron transport substance) used in the charge generation layer was changed from 3 parts to 4 parts; 10 parts of the polyallylate resin having the repeating structural unit represented by the formula (5) used in the hole transport layer were changed to 10 parts of the polycarbonate resin having the repeating structural unit represented by the formula (9); and the thickness of the hole transport layer was changed from 17 μm to 20 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 13

An electrophotographic photosensitive member was produced in the same manner as in Example 1 except that: the amount of the compound having the structure represented by the formula (3) (electron transport substance) used in the charge generation layer was changed from 3 parts to 5 parts; 10 parts of the polyallylate resin having the repeating structural unit represented by the formula (5) used in the hole transport layer were changed to 10 parts of the polycarbonate resin having the repeating structural unit represented by the formula (9); and the thickness of the hole transport layer was changed from 17 μm to 20 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 14

An electrophotographic photosensitive member was produced in the same manner as in Example 1 except that: the amount of the compound having the structure represented by the formula (3) (electron transport substance) used in the charge generation layer was changed from 3 parts to 6 parts;

10 parts of the polyallylate resin having the repeating structural unit represented by the formula (5) used in the hole transport layer were changed to 10 parts of the polycarbonate resin having the repeating structural unit represented by the formula (9); and the thickness of the hole transport layer was changed from 17 μm to 20 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 15

An electrophotographic photosensitive member was produced in the same manner as in Example 11 except that the thickness of the charge generation layer was changed from 0.16 μm to 0.12 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 16

An electrophotographic photosensitive member was produced in the same manner as in Example 11 except that the thickness of the charge generation layer was changed from 0.16 μm to 0.20 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 17

An electrophotographic photosensitive member was produced in the same manner as in Example 7 except that: the thickness of the charge generation layer was changed from 0.16 μm to 0.18 μm; and the thickness of the hole transport layer was changed from 20 μm to 13 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 18

An electrophotographic photosensitive member was produced in the same manner as in Example 1 except that the thickness of the hole transport layer was changed from 17 μm to 14 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 19

An electrophotographic photosensitive member was produced in the same manner as in Example 1 except that the thickness of the hole transport layer was changed from 17 μm to 25 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 20

An electrophotographic photosensitive member was produced in the same manner as in Example 1 except that an intermediate layer was formed as follows.

That is, 10 parts of a resin having a repeating structural unit represented by the following formula (13) (weight average molecular weight: 12,000)

[Compound 16]

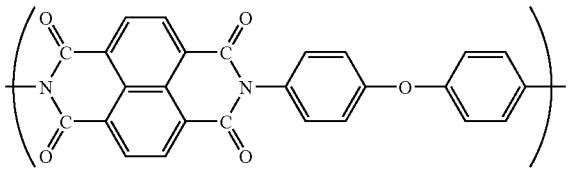

(13)

and 50 parts of N,N-dimethylacetamide were dissolved into 50 parts of tetrahydrofuran to prepare an application liquid for an intermediate layer.

The application liquid for an intermediate layer was applied onto the support by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 21

An electrophotographic photosensitive member was produced in the same manner as in Example 2 except that an intermediate layer was formed as follows.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer was applied onto the support by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 22

An electrophotographic photosensitive member was produced in the same manner as in Example 3 except that an intermediate layer was formed as follows.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer was applied onto the support by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 23

An electrophotographic photosensitive member was produced in the same manner as in Example 11 except that an intermediate layer was formed as follows.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer was applied onto the conductive layer by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 24

An electrophotographic photosensitive member was produced in the same manner as in Example 12 except that an intermediate layer was formed as follows.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer, was applied onto the conductive layer by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 25

An electrophotographic photosensitive member was produced in the same manner as in Example 13 except that an intermediate layer was formed as follows.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer was applied onto the conductive layer by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 26

An electrophotographic photosensitive member was produced in the same manner as in Example 14 except that an intermediate layer was formed as follows.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer was applied onto the conductive layer by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 27

An electrophotographic photosensitive member was produced in the same manner as in Example 15 except that an intermediate layer was formed as follows.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer was applied onto the conductive layer by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 28

An electrophotographic photosensitive member was produced in the same manner as in Example 16 except that an intermediate layer was formed as follows.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer was applied onto the conductive layer by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 29

An electrophotographic photosensitive member was produced in the same manner as in Example 8 except that: an intermediate layer was formed as follows; the thickness of the charge generation layer was changed from 0.16 μm to 0.12 μm; and the thickness of the hole transport layer was changed from 20 μm to 8 μm.

That is, 10 parts of the resin having the repeating structural unit represented by the formula (13) (weight average molecular weight: 12,000) and 50 parts of N,N-dimethylacetamide were dissolved into 50 parts of tetrahydrofuran to prepare an application liquid for an intermediate layer.

The application liquid for an intermediate layer was applied onto the conductive layer by means of dip coating and dried for 20 minutes at 180° C. to form an intermediate layer having a thickness of 0.8 μm.

Parameters relating to the expressions (I) to (III) of the produced electrophotographic photosensitive member were determined as described above. Table 1 shows the values.

The produced electrophotographic photosensitive member was evaluated in the same manner as in Example 4. Table 2 shows the results of the evaluation.

Example 30

An electrophotographic photosensitive member was produced in the same manner as in Example 1 except that the aluminum cylinder used for a support was changed to one having a diameter of 30 mm and a length of 357.5 mm.

Parameters relating to the expressions (I) to (III) of the produced electrophotographic photosensitive member were determined as described above. Table 1 shows the values.

Image output was performed in the same manner as in Example 1 (provided that a dark area potential was set to −500 V and a light area potential was set to −150 V) except that the following evaluation apparatus was used as an evaluation apparatus on which the produced electrophotographic photosensitive member was mounted. Then, an output image was evaluated. Table 2 shows the results of the evaluation.

Evaluation Apparatus

The evaluation apparatus used in Example 30 was a copying machine "GP405" manufactured by Canon Inc. (process speed: 210 mm/s). The charging means of the copying machine was contact charging means equipped with a charging roller, and a voltage obtained by superimposing an alternating voltage to a direct voltage was applied to the charging roller. At the time of use, pre-exposing means (electrostatic removal means) was turned OFF and the quantity of light was set by means of an ND filter.

Example 31

An electrophotographic photosensitive member was produced in the same manner as in Example 2 except that the aluminum cylinder used for a support was changed to one having a diameter of 30 mm and a length of 357.5 mm.

Parameters relating to the expressions (I) to (III) of the produced electrophotographic photosensitive member were determined as described above. Table 1 shows the values.

The produced electrophotographic photosensitive member was evaluated in the same manner as in Example 30. Table 2 shows the results of the evaluation.

Example 32

An electrophotographic photosensitive member was produced in the same manner as in Example 3 except that the aluminum cylinder used for a support was changed to one having a diameter of 30 mm and a length of 357.5 mm.

Parameters relating to the expressions (I) to (III) of the produced electrophotographic photosensitive member were determined as described above. Table 1 shows the values.

The produced electrophotographic photosensitive member was evaluated in the same manner as in Example 30. Table 2 shows the results of the evaluation.

Example 33

An electrophotographic photosensitive member was produced in the same manner as in Example 1 except that the aluminum cylinder used for a support was changed to one having a diameter of 30 mm and a length of 357.5 mm.

Parameters relating to the expressions (I) to (III) of the produced electrophotographic photosensitive member were determined as described above. Table 1 shows the values.

Image output was performed in the same manner as in Example 1 (provided that a dark area potential was set to −500 V and a light area potential was set to −150 V) except that the following evaluation apparatus was used as an evaluation apparatus on which the produced electrophotographic photosensitive member was mounted. Then, an output image was evaluated. Table 2 shows the results of the evaluation.

Evaluation Apparatus

The evaluation apparatus used in Example 33 was a remodeled device of a copying machine "GP405" manufactured by Canon Inc. (process speed: 210 mm/s). The copying machine was remodeled, with the result that the charging means was changed to corona charging means equipped with a corona discharger. At the time of use, pre-exposing means (electrostatic removal means) was turned OFF and the quantity of light was set by means of an ND filter.

Example 34

An electrophotographic photosensitive member was produced in the same manner as in Example 2 except that the aluminum cylinder used for a support was changed to one having a diameter of 30 mm and a length of 357.5 mm.

Parameters relating to the expressions (I) to (III) of the produced electrophotographic photosensitive member were determined as described above. Table 1 shows the values.

The produced electrophotographic photosensitive member was evaluated in the same manner as in Example 33. Table 2 shows the results of the evaluation.

Example 35

An electrophotographic photosensitive member was produced in the same manner as in Example 3 except that the aluminum cylinder used for a support was changed to one having a diameter of 30 mm and a length of 357.5 mm.

Parameters relating to the expressions (I) to (III) of the produced electrophotographic photosensitive member were determined as described above. Table 1 shows the values.

The produced electrophotographic photosensitive member was evaluated in the same manner as in Example 33. Table 2 shows the results of the evaluation.

[Table 1]

TABLE 1

| | $V_A$ [V] | $V_B$ [V] | d [μm] | $(\lvert -600 - V_A \rvert - \lvert -600 - V_B \rvert)/d$ | $V_c$ [V] | $-(-450 - V_c)$ [V] | m |
|---|---|---|---|---|---|---|---|
| Example 1 | −593.2 | −594.5 | 17 | 0.08 | −453.5 | −3.5 | $2.5 \times 10^{-4}$ |
| Example 2 | −592.9 | −594.5 | 17 | 0.09 | −454.0 | −4.0 | $4.2 \times 10^{-4}$ |
| Example 3 | −593.1 | −594.5 | 17 | 0.08 | −453.5 | −3.5 | $6.6 \times 10^{-4}$ |
| Example 4 | −593.2 | −594.5 | 17 | 0.08 | −453.5 | −3.5 | $2.5 \times 10^{-4}$ |
| Example 5 | −592.9 | −594.5 | 17 | 0.09 | −454.0 | −4.0 | $4.2 \times 10^{-4}$ |
| Example 6 | −593.1 | −594.5 | 17 | 0.08 | −453.5 | −3.5 | $6.6 \times 10^{-4}$ |
| Example 7 | −592.7 | −595.1 | 20 | 0.12 | −454.3 | −4.3 | $5.2 \times 10^{-3}$ |
| Example 8 | −593.1 | −595.1 | 20 | 0.10 | −454.3 | −4.3 | $9.2 \times 10^{-4}$ |
| Example 9 | −592.8 | −595.2 | 20 | 0.12 | −454.5 | −4.5 | $6.9 \times 10^{-4}$ |
| Example 10 | −592.8 | −595.2 | 20 | 0.12 | −453.5 | −3.5 | $3.6 \times 10^{-3}$ |
| Example 11 | −593.2 | −595.1 | 20 | 0.09 | −453.0 | −3.0 | $2.4 \times 10^{-4}$ |
| Example 12 | −593.0 | −595.1 | 20 | 0.11 | −452.5 | −2.5 | $2.8 \times 10^{-4}$ |
| Example 13 | −592.8 | −595.1 | 20 | 0.12 | −453.5 | −3.5 | $8.8 \times 10^{-4}$ |
| Example 14 | −592.6 | −595.1 | 20 | 0.13 | −454.8 | −4.8 | $3.1 \times 10^{-4}$ |
| Example 15 | −593.8 | −595.1 | 20 | 0.07 | −454.8 | −4.8 | $8.2 \times 10^{-5}$ |
| Example 16 | −592.6 | −595.1 | 20 | 0.13 | −448.0 | +2.0 | $1.5 \times 10^{-3}$ |
| Example 17 | −592.3 | −593.9 | 13 | 0.12 | −453.7 | −3.7 | $7.3 \times 10^{-3}$ |
| Example 18 | −593.3 | −594.3 | 14 | 0.07 | −453.4 | −3.4 | $2.5 \times 10^{-4}$ |
| Example 19 | −593.5 | −596.3 | 25 | 0.11 | −454.8 | −4.8 | $3.0 \times 10^{-4}$ |
| Example 20 | −593.6 | −594.5 | 17 | 0.05 | −451.9 | −1.9 | $2.2 \times 10^{-4}$ |
| Example 21 | −593.4 | −594.5 | 17 | 0.06 | −451.6 | −1.6 | $3.5 \times 10^{-4}$ |
| Example 22 | −593.4 | −594.6 | 17 | 0.07 | −451.2 | −1.2 | $6.8 \times 10^{-4}$ |
| Example 23 | −593.5 | −595.1 | 20 | 0.08 | −451.5 | −1.5 | $2.8 \times 10^{-4}$ |
| Example 24 | −593.4 | −595.1 | 20 | 0.09 | −451.3 | −1.3 | $3.0 \times 10^{-4}$ |
| Example 25 | −593.2 | −595.1 | 20 | 0.09 | −452.0 | −2.0 | $6.2 \times 10^{-4}$ |
| Example 26 | −593.1 | −595.1 | 20 | 0.10 | −453.4 | −3.4 | $5.2 \times 10^{-4}$ |
| Example 27 | −594.4 | −595.1 | 20 | 0.04 | −453.4 | −3.4 | $7.2 \times 10^{-5}$ |
| Example 28 | −593.2 | −595.1 | 20 | 0.09 | −449.9 | +0.1 | $1.2 \times 10^{-3}$ |
| Example 29 | −593.4 | −593.5 | 8 | 0.01 | −454.5 | −4.5 | $2.0 \times 10^{-4}$ |
| Example 30 | −593.2 | −594.5 | 17 | 0.08 | −453.5 | −3.5 | $2.5 \times 10^{-4}$ |
| Example 31 | −592.9 | −594.5 | 17 | 0.09 | −454.0 | −4.0 | $4.2 \times 10^{-4}$ |
| Example 32 | −593.1 | −594.5 | 17 | 0.08 | −453.5 | −3.5 | $6.6 \times 10^{-4}$ |
| Example 33 | −593.2 | −594.5 | 17 | 0.08 | −453.5 | −3.5 | $2.5 \times 10^{-4}$ |
| Example 34 | −592.9 | −594.5 | 17 | 0.09 | −454.0 | −4.0 | $4.2 \times 10^{-4}$ |
| Example 35 | −593.1 | −594.5 | 17 | 0.08 | −453.5 | −3.5 | $6.6 \times 10^{-4}$ |

[Table 2]

TABLE 2

| | Normal-temperature-and-normal-humidity environment (23° C., 50% RH) | | | | Low-temperature-and-low-humidity environment (15° C., 10% RH) | | | |
|---|---|---|---|---|---|---|---|---|
| | Initial stage | | After endurance | | Initial stage | | After endurance | |
| | First sheet | Twelfth sheet | First sheet | Twelfth sheet | First sheet | Twelfth sheet | First sheet | Twelfth sheet |
| Example 1 | 0.00 | 0.00 | 0.00 | 0.00 | 0.00 | 0.00 | +0.01 | +0.01 |
| Example 2 | 0.00 | 0.00 | 0.00 | 0.00 | 0.00 | 0.00 | +0.01 | +0.01 |
| Example 3 | 0.00 | 0.00 | 0.00 | 0.00 | 0.00 | +0.01 | +0.02 | +0.02 |
| Example 4 | 0.00 | 0.00 | +0.01 | +0.01 | 0.00 | +0.01 | +0.02 | +0.02 |
| Example 5 | 0.00 | 0.00 | +0.01 | +0.01 | 0.00 | +0.01 | +0.02 | +0.02 |
| Example 6 | 0.00 | 0.00 | +0.01 | +0.01 | 0.00 | +0.01 | +0.02 | +0.02 |
| Example 7 | 0.00 | 0.00 | +0.02 | +0.02 | 0.00 | +0.01 | +0.04 | +0.04 |
| Example 8 | 0.00 | +0.01 | +0.01 | +0.01 | 0.00 | +0.01 | +0.02 | +0.02 |
| Example 9 | 0.00 | +0.01 | +0.01 | +0.01 | 0.00 | +0.01 | +0.02 | +0.02 |

TABLE 2-continued

| | Normal-temperature-and-normal-humidity environment (23° C., 50% RH) | | | | Low-temperature-and-low-humidity environment (15° C., 10% RH) | | | |
|---|---|---|---|---|---|---|---|---|
| | Initial stage | | After endurance | | Initial stage | | After endurance | |
| | First sheet | Twelfth sheet | First sheet | Twelfth sheet | First sheet | Twelfth sheet | First sheet | Twelfth sheet |
| Example 10 | 0.00 | +0.01 | +0.02 | +0.02 | 0.00 | +0.01 | +0.04 | +0.04 |
| Example 11 | 0.00 | 0.00 | +0.01 | +0.01 | 0.00 | +0.01 | +0.03 | +0.03 |
| Example 12 | 0.00 | 0.00 | +0.01 | +0.01 | 0.00 | +0.01 | +0.03 | +0.03 |
| Example 13 | 0.00 | 0.00 | +0.01 | +0.01 | 0.00 | +0.01 | +0.03 | +0.03 |
| Example 14 | 0.00 | 0.00 | +0.01 | +0.01 | 0.00 | +0.01 | +0.03 | +0.03 |
| Example 15 | 0.00 | 0.00 | +0.01 | +0.01 | −0.03 | +0.01 | +0.02 | +0.02 |
| Example 16 | 0.00 | 0.00 | +0.01 | +0.01 | 0.00 | +0.01 | +0.03 | +0.03 |
| Example 17 | 0.00 | 0.00 | +0.02 | +0.02 | 0.00 | 0.00 | +0.04 | +0.04 |
| Example 18 | 0.00 | 0.00 | +0.01 | +0.01 | 0.00 | +0.01 | +0.03 | +0.03 |
| Example 19 | 0.00 | 0.00 | +0.01 | +0.01 | 0.00 | +0.01 | +0.03 | +0.03 |
| Example 20 | 0.00 | 0.00 | +0.01 | +0.01 | 0.00 | +0.01 | +0.01 | +0.02 |
| Example 21 | 0.00 | 0.00 | +0.01 | +0.01 | 0.00 | +0.01 | +0.02 | +0.02 |
| Example 22 | 0.00 | 0.00 | +0.01 | +0.01 | 0.00 | +0.01 | +0.02 | +0.02 |
| Example 23 | 0.00 | 0.00 | +0.01 | +0.01 | 0.00 | +0.01 | +0.02 | +0.02 |
| Example 24 | 0.00 | 0.00 | +0.01 | +0.01 | 0.00 | +0.01 | +0.02 | +0.02 |
| Example 25 | 0.00 | 0.00 | +0.01 | +0.01 | 0.00 | +0.01 | +0.02 | +0.02 |
| Example 26 | 0.00 | 0.00 | +0.01 | +0.01 | 0.00 | +0.01 | +0.03 | +0.03 |
| Example 27 | −0.01 | 0.00 | +0.01 | +0.01 | −0.04 | 0.00 | +0.02 | +0.02 |
| Example 28 | 0.00 | 0.00 | +0.01 | +0.01 | 0.00 | +0.01 | +0.03 | +0.03 |
| Example 29 | 0.00 | 0.00 | +0.01 | +0.01 | −0.02 | −0.02 | +0.04 | +0.04 |
| Example 30 | 0.00 | 0.00 | +0.01 | +0.01 | 0.00 | 0.00 | +0.01 | +0.01 |
| Example 31 | 0.00 | 0.00 | +0.01 | +0.01 | 0.00 | 0.00 | +0.01 | +0.01 |
| Example 32 | 0.00 | 0.00 | +0.01 | +0.01 | 0.00 | 0.00 | +0.02 | +0.02 |
| Example 33 | 0.00 | 0.00 | +0.01 | +0.01 | 0.00 | 0.00 | +0.02 | +0.02 |
| Example 34 | 0.00 | 0.00 | +0.01 | +0.01 | 0.00 | 0.00 | +0.02 | +0.02 |
| Example 35 | 0.00 | 0.00 | +0.01 | +0.01 | 0.00 | 0.00 | +0.02 | +0.02 |

Comparative Example 1

An electrophotographic photosensitive member was produced in the same manner as in Example 1 except that the compound having the structure represented by the formula (3) was not incorporated into the charge generation layer.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 2

An aluminum cylinder having a diameter of 30 mm and a length of 260.5 mm was provided as a support.

Next, 50 parts of titanium oxide particles coated with tin oxide containing 10 mass % antimony oxide, 25 parts of a resole-type phenol resin, 30 parts of methoxypropanol, 30 parts of methanol, and 0.002 part of silicone oil (polydimethylsiloxane polyoxyalkylene copolymer, weight average molecular weight: 3,000) were dispersed by using a sand mill device using glass beads each having a diameter of 1 mm for 2 hours to prepare an application liquid for a conductive layer.

The application liquid for a conductive layer was applied onto the support by means of dip coating and dried for 30 minutes at 140° C. to form a conductive layer having a thickness of 20 μm.

Next, 10 parts of N-methoxymethylated nylon 6 were dissolved into 200 parts of methanol to prepare an application liquid for an intermediate layer.

The application liquid for an intermediate layer was applied onto the conductive layer by means of dip coating and dried for 10 minutes at 90° C. to form an intermediate layer having a thickness of 0.7 μm.

Next, 10 parts of an oxytitanium phthalocyanine crystal of a crystal form (charge generation substance) having strong peaks at Bragg angles 2 θ±0.2° in CuKα characteristic X-ray diffraction of 9.0°, 14.2°, 23.9°, and 27.1°, a 5-mass % (polyvinyl butyral resin concentration) solution prepared by dissolving a polyvinyl butyral resin (trade name: S-LEC BX-1, manufactured by Sekisui Chemical Co., Ltd.) into cyclohexanone, and a mixed solvent of 97 parts of cyclohexanone/3 parts of water were dispersed by using a sand mill device using glass beads each having a diameter of 1 mm for 4 hours. Next, a mixed solvent of 203.7 parts of cyclohexanone/6.3 parts of water and 260 parts of cyclohexanone were added to the resultant to prepare an application liquid for a charge generation layer.

The application liquid for a charge generation layer was applied onto the intermediate layer by means of dip coating and dried for 10 minutes at 80° C. to form a charge generation layer having a thickness of 0.2 μm.

Next, 9 parts of a compound having a structure represented by the following formula (14) (hole transport substance),

[Compound 17]

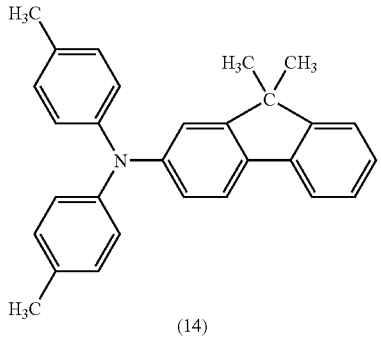

(14)

1 part of the compound having the structure represented by the formula (4) (hole transport substance), and 10 parts of the polycarbonate resin having the repeating structural unit represented by the formula (9) (weight average molecular weight: 20,000) were dissolved into a mixed solvent of 60 parts of monochlorobenzene/40 parts of dichloromethane to prepare an application liquid for a hole transport layer.

The application liquid for a hole transport layer was applied onto the charge generation layer by means of dip coating and dried for 1 hour at 115° C. to form a hole transport layer having a thickness of 22 μm.

Thus, an electrophotographic photosensitive member which had the support, which had the conductive layer, the intermediate layer, the charge generation layer, and the hole transport layer laminated in this order on the support, and in which the hole transport layer was a surface layer was produced.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 3

An electrophotographic photosensitive member was produced in the same manner as in Example 11 except that 2.5 parts of the compound having the structure represented by the formula (3) (electron transport substance) used in the charge generation layer were changed to 2.5 parts of a compound having a structure represented by the following formula (15) (electron transport substance, reduction potential: −0.68 V).

[Compound 18]

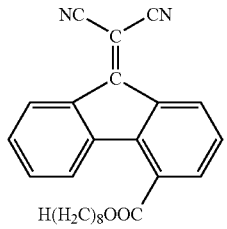

(15)

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 4

An electrophotographic photosensitive member was produced in the same manner as in Example 11 except that 2.5 parts of the compound having the structure represented by the formula (3) (electron transport substance) used in the charge generation layer were changed to 2.5 parts of a compound having a structure represented by the following formula (16) (electron transport substance, reduction potential: −0.60 V).

[Compound 19]

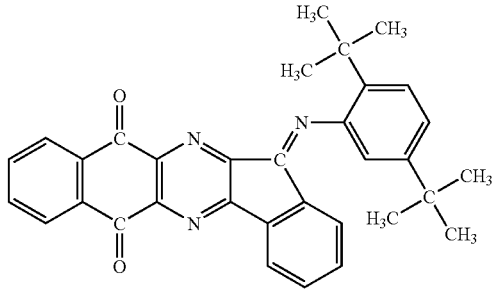

(16)

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 5

The surface of an aluminum cylinder having a diameter of 30 mm and a length of 260.5 mm was subjected to wet honing treatment and ultrasonic water washing, and the resultant was provided as a support.

Next, 5 parts of N-methoxymethylated nylon 6 were dissolved into 95 parts of methanol to prepare an application liquid for an intermediate layer.

The application liquid for an intermediate layer was applied onto the support by means of dip coating and dried for 20 minutes at 100° C. to form an intermediate layer having a thickness of 0.6 μm.

Next, 3 parts of an oxytitanium phthalocyanine crystal of a crystal form (charge generation substance) having strong peaks at Bragg angles 2θ±0.2° in CuKα characteristic X-ray diffraction of 9.0°, 14.2°, 23.9°, and 27.1°, 2 parts of a polyvinyl butyral resin (trade name: S-LEC BX-1, manufactured by Sekisui Chemical Co., Ltd.), 0.03 part of a compound having a structure represented by the following formula (17) (electron transport substance, reduction potential: −0.50 V),

[Compound 20]

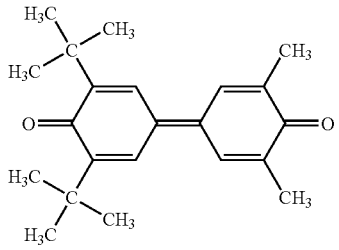

(17)

and 80 parts of cyclohexanone were dispersed by using a sand mill device using glass beads each having a diameter of 1 mm for 4 hours. Next, 115 parts of methyl ethyl ketone were added to the dispersion to prepare an application liquid for a charge generation layer.

The application liquid for a charge generation layer was applied onto the intermediate layer by means of dip coating and dried for 10 minutes at 100° C. to form a charge generation layer having a thickness of 0.20 μm.

Next, 10 parts of the compound having the structure represented by the formula (4) (hole transport substance) and 10 parts of the polycarbonate resin having the repeating structural unit represented by the formula (9) (weight average molecular weight: 20,000) were dissolved into a mixed solvent of 50 parts of monochlorobenzene/10 parts of dichloromethane to prepare an application liquid for a hole transport layer.

The application liquid for a hole transport layer was applied onto the charge generation layer by means of dip coating and dried for 1 hour at 110° C. to form a hole transport layer having a thickness of 20 μm.

Thus, an electrophotographic photosensitive member which had the support, which had the intermediate layer, the charge generation layer, and the hole transport layer laminated in this order on the support, and in which the hole transport layer was a surface layer was produced.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 6

An electrophotographic photosensitive member was produced in the same manner as in Comparative Example 5 except that 0.03 part of the compound having the structure represented by the formula (17) (electron transport substance) used in the charge generation layer was changed to 0.03 part of a compound having a structure represented by the following formula (18) (electron transport substance, reduction potential: −0.50 V).

[Compound 21]

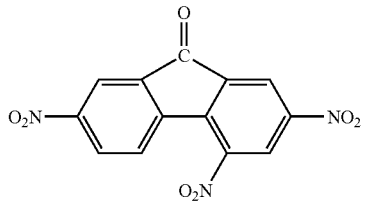

(18)

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 7

An electrophotographic photosensitive member was produced in the same manner as in Comparative Example 5 except that the compound having the structure represented by the formula (17) (electron transport substance) was not incorporated into the charge generation layer.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 8

The surface of an aluminum cylinder having a diameter of 30 mm and a length of 260.5 mm was subjected to wet honing treatment and ultrasonic water washing, and the resultant was provided as a support.

Next, 5 parts of N-methoxymethylated nylon 6 were dissolved into 95 parts of methanol to prepare an application liquid for an intermediate layer.

The application liquid for an intermediate layer was applied onto the support by means of dip coating and dried for 20 minutes at 100° C. to form an intermediate layer having a thickness of 0.6 μm.

Next, 20 parts of a bisazo pigment having a structure represented by the following formula (19) (charge generation substance),

[Compound 22]

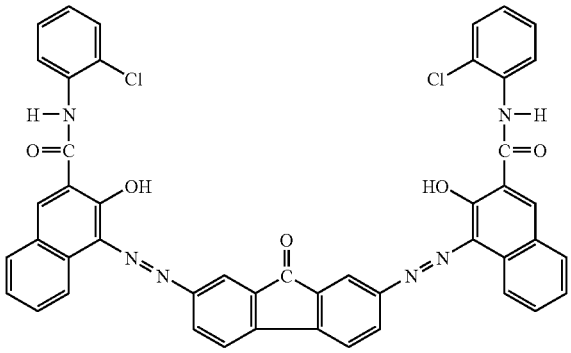

(19)

10 parts of the polycarbonate having the repeating structural unit represented by the formula (9), 5 parts of a compound having a structure represented by the following formula (20) (electron transport substance, reduction potential: −0.37 V),

[Compound 23]

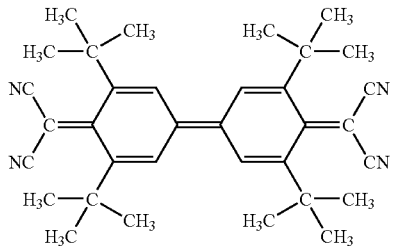

(20)

and 150 parts of tetrahydrofuran were dispersed by using a sand mill device using glass beads each having a diameter of 1 mm for 4 hours to prepare an application liquid for a charge generation layer.

The application liquid for a charge generation layer was applied onto the intermediate layer by means of dip coating and dried for 30 minutes at 110° C. to form a charge generation layer having a thickness of 0.5 μm.

Next, 10 parts of a compound having a structure represented by the following formula (21)

[Compound 24]

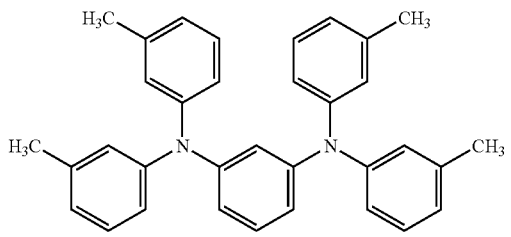

(21)

and 10 parts of the polycarbonate having the repeating structural unit represented by the formula (9) were dissolved into 10 parts of tetrahydrofuran to prepare an application liquid for a hole transport layer.

The application liquid for a hole transport layer was applied onto the charge generation layer by means of dip coating and dried for 30 minutes at 110° C. to form a hole transport layer having a thickness of 20 μm.

Thus, an electrophotographic photosensitive member which had the support, which had the intermediate layer, the charge generation layer, and the hole transport layer laminated in this order on the support, and in which the hole transport layer was a surface layer was produced.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 9

The surface of an aluminum cylinder having a diameter of 30 mm and a length of 260.5 mm was subjected to wet honing treatment and ultrasonic water washing, and the resultant was provided as a support.

Next, 5 parts of N-methoxymethylated nylon 6 were dissolved into 95 parts of methanol to prepare an application liquid for an intermediate layer.

The application liquid for an intermediate layer was applied onto the support by means of dip coating and dried for 20 minutes at 100° C. to form an intermediate layer having a thickness of 0.6 μm.

Next, 10 parts of an oxytitanium phthalocyanine crystal of a crystal form (charge generation substance) having strong peaks at Bragg angles 2θ±0.2° in CuKα characteristic X-ray diffraction of 9.0°, 14.2°, 23.9°, and 27.1°, 0.3 part of a compound having a structure represented by the following formula (22) (singlet oxygen deactivating agent),

[Compound 25]

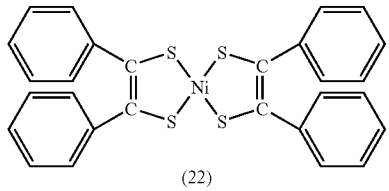

(22)

10 parts of a polyvinyl butyral resin (trade name: S-LEC BX-1, manufactured by Sekisui Chemical Co., Ltd.), and 400 parts of cyclohexanone were dispersed by using a sand mill device using glass beads (400 parts) each having a diameter of 1 mm for 5 hours. After that, 400 parts of ethyl acetate were added to the dispersion to prepare an application liquid for a charge generation layer.

The application liquid for a charge generation layer was applied onto the intermediate layer by means of dip coating and dried for 10 minutes at 80° C. to form a charge generation layer having a thickness of 0.2 μm.

Next, 10 parts of the compound having the structure represented by the formula (4) (hole transport substance) and 10 parts of the polycarbonate having the repeating structural unit represented by the formula (9) were dissolved into a mixed solvent of 50 parts of monochlorobenzene/10 parts of dichloromethane to prepare an application liquid for a hole transport layer.

The application liquid for a hole transport layer was applied onto the charge generation layer by means of dip coating and dried for 1 hour at 110° C. to form a hole transport layer having a thickness of 20 μm.

Thus, an electrophotographic photosensitive member which had the support, which had the intermediate layer, the charge generation layer, and the hole transport layer laminated in this order on the support, and in which the hole transport layer was a surface layer was produced.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 10

The surface of an aluminum cylinder having a diameter of 30 mm and a length of 260.5 mm was subjected to wet honing treatment and ultrasonic water washing, and the resultant was provided as a support.

Next, 8 parts of a polyvinyl butyral resin (trade name: S-LEC BM-2, manufactured by Sekisui Chemical Co., Ltd.) were dissolved into 152 parts of n-butyl alcohol. Next, a solution prepared by mixing 100 parts of a toluene solution containing 50 mass % tributoxyzirconium acetylacetonate (trade name: ZC-540, manufactured by Matsumoto Kosho), 10 parts of γ-aminopropyltrimethoxysilane (trade name: A1100, manufactured by Nippon Unicar Co., Ltd.), and 130 parts of n-butyl alcohol was added to a liquid prepared by dissolving the polyvinyl butyral resin described above into n-butyl alcohol, and the whole was stirred to prepare an application liquid for an intermediate layer.

The application liquid for an intermediate layer was applied onto the support by means of dip coating and dried for 10 minutes at 150° C. to form an intermediate layer having a thickness of 1.0 μm.

Next, 4 parts of a chlorogallium phthalocyanine crystal of a crystal form (charge generation substance) having strong peaks at Bragg angles 2θ±0.2° in CuKα characteristic X-ray diffraction of 7.4°, 16.6°, 25.5°, and 28.2°, 4 parts of a vinyl chloride-vinyl acetate-maleic acid copolymer (manufactured by Union Carbide), and 100 parts of n-butyl acetate were dispersed by using a dyno-mill device using glass beads each having a diameter of 1 mm for 12 hours to prepare an application liquid for a charge generation layer.

The application liquid for a charge generation layer was applied onto the intermediate layer by means of dip coating and dried for 10 minutes at 100° C. to form a charge generation layer having a thickness of 0.25 μm.

Next, 4 parts of N,N'-diphenyl-N,N'-bis(3-methyphenyl)-[1,1'-biphenyl]-4,4'-diamine (hole transport substance) and 6 parts of the polycarbonate resin having the repeating structural unit represented by the formula (9) were dissolved into 40 parts of monochlorobenzene to prepare an application liquid for a hole transport layer.

The application liquid for a hole transport layer was applied onto the charge generation layer by means of dip coating and dried for 40 minutes at 120° C. to form a hole transport layer having a thickness of 20 μm.

Thus, an electrophotographic photosensitive member which had the support, which had the intermediate layer, the charge generation layer, and the hole transport layer laminated in this order on the support, and in which the hole transport layer was a surface layer was produced.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 11

The surface of an aluminum cylinder having a diameter of 30 mm and a length of 260.5 mm was subjected to wet honing treatment and ultrasonic water washing, and the resultant was provided as a support.

Next, 5 parts of N-methoxymethylated nylon 6 were dissolved into 95 parts of methanol to prepare an application liquid for an intermediate layer.

The application liquid for an intermediate layer was applied onto the support by means of dip coating and dried for 20 minutes at 100° C. to form an intermediate layer having a thickness of 0.6 μm.

Next, 10 parts of a chlorogallium phthalocyanine crystal of a crystal form (charge generation substance) having strong peaks at Bragg angles 2θ±0.2° in CuKα characteristic X-ray diffraction of 7.4°, 16.6°, 25.5°, and 28.2°, 10 parts of a vinyl chloride-vinyl acetate copolymer (manufactured by Union Carbide), and 200 parts of n-butyl acetate were dispersed by using a sand mill device using glass beads each having a diameter of 1 mm for 3 hours. After that, 1 part of a compound having a structure represented by the following formula (23) (hole transport substance)

[Compound 26]

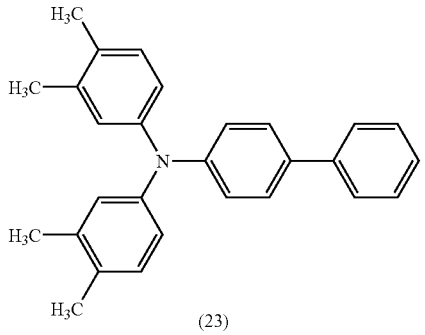

(23)

was added to the dispersion, and the whole was dispersed for an additional 1 hour to prepare an application liquid for a charge generation layer.

The application liquid for a charge generation layer was applied onto the intermediate layer by means of dip coating and dried for 10 minutes at 100° C. to form a charge generation layer having a thickness of 0.2 μm.

Next, 10 parts of the compound having the structure represented by the formula (23) (hole transport substance) and 10 parts of the polycarbonate having the repeating structural unit represented by the formula (9) were dissolved into 60 parts of monochlorobenzene to prepare an application liquid for a hole transport layer.

The application liquid for a hole transport layer was applied onto the charge generation layer by means of dip coating and dried for 1 hour at 110° C. to form a hole transport layer having a thickness of 25 μm.

Thus, an electrophotographic photosensitive member which had the support, which had the intermediate layer, the charge generation layer, and the hole transport layer laminated in this order on the support, and in which the hole transport layer was a surface layer was produced.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 12

An electrophotographic photosensitive member was produced in the same manner as in Example 7 except that the thickness of the charge generation layer was changed from 0.16 μm to 0.08 μm.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 13

An electrophotographic photosensitive member was produced in the same manner as in Example 7 except that the thickness of the charge generation layer was changed from 0.16 μm to 0.3 μm.

Parameters relating to the expressions (I) and (II) of the produced electrophotographic photosensitive member were determined as described above. Table 3 shows the values.

The produced electrophotographic photosensitive member was evaluated in the same manner as in Example 4. Table 4 shows the results of the evaluation.

Comparative Example 15

An electrophotographic photosensitive member was produced in the same manner as in Comparative Example 1 except that the aluminum cylinder used for a support was changed to one having a diameter of 30 mm and a length of 357.5 mm.

Parameters relating to the expressions (I) and (II) of the produced electrophotographic photosensitive member were determined as described above. Table 3 shows the values.

The produced electrophotographic photosensitive member was evaluated in the same manner as in Example 33. Table 4 shows the results of the evaluation.

Comparative Example 16

An electrophotographic photosensitive member was produced in the same manner as in Comparative Example 2 except that the aluminum cylinder used for a support was changed to one having a diameter of 30 mm and a length of 357.5 mm.

Parameters relating to the expressions (I) and (II) of the produced electrophotographic photosensitive member were determined as described above. Table 3 shows the values.

The produced electrophotographic photosensitive member was evaluated in the same manner as in Example 33. Table 4 shows the results of the evaluation.

Comparative Example 17

An electrophotographic photosensitive member was produced in the same manner as in Comparative Example 5 except that the aluminum cylinder used for a support was changed to one having a diameter of 30 mm and a length of 357.5 mm.

Parameters relating to the expressions (I) and (II) of the produced electrophotographic photosensitive member were determined as described above. Table 3 shows the values.

The produced electrophotographic photosensitive member was evaluated in the same manner as in Example 33. Table 4 shows the results of the evaluation.

[Table 3]

TABLE 3

| | $V_A$ [V] | $V_B$ [V] | d [μm] | $(\lvert -600 - V_A \rvert - \lvert -600 - V_B \rvert)/d$ | $V_c$ [V] | $-(-450 - V_c)$ [V] |
|---|---|---|---|---|---|---|
| Comparative Example 1 | −591.3 | −595.1 | 17 | 0.19 | −455.0 | −5.0 |
| Comparative Example 2 | −592.3 | −595.8 | 22 | 0.16 | −457.5 | −7.5 |
| Comparative Example 3 | −591.6 | −595.2 | 20 | 0.18 | −455.5 | −5.5 |
| Comparative Example 4 | −592.7 | −595.1 | 20 | 0.12 | −456.2 | −6.2 |
| Comparative Example 5 | −592.1 | −595.2 | 20 | 0.16 | −461.5 | −11.5 |
| Comparative Example 6 | −592.2 | −595.1 | 20 | 0.14 | −461.2 | −11.2 |
| Comparative Example 7 | −591.8 | −595.2 | 20 | 0.17 | −462.7 | −12.7 |
| Comparative Example 8 | −592.8 | −595.2 | 20 | 0.12 | −447.0 | +3.0 |
| Comparative Example 9 | −591.9 | −595.1 | 20 | 0.16 | −459.4 | −9.4 |
| Comparative Example 10 | −590.7 | −595.0 | 20 | 0.21 | −455.3 | −5.3 |
| Comparative Example 11 | −592.0 | −596.5 | 25 | 0.18 | −452.9 | −2.9 |
| Comparative Example 12 | −594.1 | −595.1 | 20 | 0.05 | −456.2 | −6.2 |
| Comparative Example 13 | −590.6 | −595.2 | 20 | 0.23 | −450.2 | −0.2 |
| Comparative Example 14 | −592.9 | −596.4 | 25 | 0.14 | −456.5 | −6.5 |
| Comparative Example 15 | −591.3 | −595.1 | 17 | 0.19 | −455.0 | −5.0 |
| Comparative Example 16 | −592.3 | −595.8 | 22 | 0.16 | −457.5 | −7.5 |
| Comparative Example 17 | −592.1 | −595.2 | 20 | 0.16 | −461.5 | −11.5 |

TABLE 4

| | Normal-temperature-and-normal-humidity environment (23° C., 50% RH) | | | | Low-temperature-and-low-humidity environment (15° C., 10% RH) | | | |
|---|---|---|---|---|---|---|---|---|
| | Initial stage | | After endurance | | Initial stage | | After endurance | |
| | First sheet | Twelfth sheet | First sheet | Twelfth sheet | First sheet | Twelfth sheet | First sheet | Twelfth sheet |
| Comparative Example 1 | 0.00 | +0.01 | +0.05 | +0.05 | 0.00 | +0.01 | +0.08 | +0.08 |
| Comparative Example 2 | −0.12 | −0.02 | +0.05 | +0.05 | −0.16 | −0.01 | +0.06 | +0.08 |
| Comparative Example 3 | −0.08 | −0.01 | +0.04 | +0.04 | −0.12 | 0.00 | +0.06 | +0.07 |

TABLE 4-continued

| | Normal-temperature-and-normal-humidity environment (23° C., 50% RH) | | | | Low-temperature-and-low-humidity environment (15° C., 10% RH) | | | |
|---|---|---|---|---|---|---|---|---|
| | Initial stage | | After endurance | | Initial stage | | After endurance | |
| | First sheet | Twelfth sheet | First sheet | Twelfth sheet | First sheet | Twelfth sheet | First sheet | Twelfth sheet |
| Comparative Example 4 | −0.08 | +0.01 | +0.01 | +0.01 | −0.13 | −0.06 | +0.03 | +0.03 |
| Comparative Example 5 | −0.15 | −0.03 | +0.04 | +0.04 | −0.18 | −0.01 | +0.06 | +0.08 |
| Comparative Example 6 | −0.15 | −0.03 | +0.03 | +0.03 | −0.19 | −0.02 | +0.08 | +0.09 |
| Comparative Example 7 | −0.15 | −0.05 | +0.05 | +0.05 | −0.17 | −0.01 | +0.09 | +0.11 |
| Comparative Example 8 | +0.05 | +0.05 | +0.07 | +0.07 | +0.05 | +0.06 | +0.09 | +0.08 |
| Comparative Example 9 | −0.12 | −0.02 | +0.04 | +0.05 | −0.14 | 0.00 | +0.06 | +0.09 |
| Comparative Example 10 | −0.01 | −0.01 | +0.02 | +0.02 | −0.08 | −0.01 | +0.12 | +0.12 |
| Comparative Example 11 | 0.00 | +0.01 | +0.04 | +0.04 | +0.02 | +0.02 | +0.08 | +0.09 |
| Comparative Example 12 | −0.08 | +0.01 | +0.01 | +0.01 | −0.13 | −0.06 | +0.02 | +0.02 |
| Comparative Example 13 | 0.00 | +0.01 | +0.06 | +0.06 | +0.01 | +0.03 | +0.12 | +0.12 |
| Comparative Example 15 | 0.00 | +0.01 | +0.05 | +0.05 | −0.01 | +0.01 | +0.08 | +0.08 |
| Comparative Example 16 | −0.08 | −0.02 | +0.04 | +0.04 | −0.14 | −0.01 | +0.08 | +0.09 |
| Comparative Example 17 | −0.12 | −0.02 | +0.04 | +0.04 | −0.15 | −0.01 | +0.08 | +0.08 |

It was determined that, for an example in which the average value of 10 measurements of the density obtained by subtracting the density of the halftone portion 904 from the density of the portion 903 at which a ghost was able to appear was equal to or greater than 0.05, the effect of the present invention was not obtained sufficiently.

As can be seen from Tables 2 and 4, in each of Comparative Examples 1 to 3, 5 to 7, 9 to 11, and 13 to 17, the ghost level increased after endurance because $(|-600-V_A|-|-600V_B|)/d$ was greater than 0.13. In each of Comparative Examples 2 to 7, 9, 10, 12, 14, 16, and 17, a negative ghost occurred on the first sheet because $-(-450-V_C)$ was smaller than −5. In Comparative Example 8, a positive ghost tended to occur because $-(-450-V_C)$ was greater than 2. Comparison between Example 2 and Comparative Example 14 equal in $V_A$ to each other or between Example 17 and Comparative Example 2 equal in $V_A$ to each other shows that a positive ghost occurs after endurance in a comparative example.

This application claims priority from Japanese Patent Application No. 2003-434013 filed Dec. 26, 2003, which is hereby incorporated by reference herein.

The invention claimed is:

1. An electrophotographic photosensitive member, comprising:

a support;

a charge generation layer containing a charge generation substance, the charge generation layer being placed on the support; and a hole transport layer containing a hole transport substance, the hole transport layer being placed on the charge generation layer, wherein the charge generation substance is hydroxygallium phthalocvanine, and the charge generation layer further comprises an electron transport substance having a reduction potential in a range of −0.54 to −0.25 V, and the thickness of the charge generation layer is in a range of 0.12 to 0.20 μm, wherein the following expression (I) is satisfied for said electrophotographic photosensitive member:

$$(|-600-V_A|-|-600-V_B|)/d \leqq 0.13 \quad \text{(I)}$$

wherein $V_A$, in units of volts, represents a surface potential of the electrophotographic photosensitive member obtained by: rotating the electrophotographic photosensitive member 5 times while charging a surface of the electrophotographic photosensitive member by means of a charging device set to a predetermined charging condition $C_1$ to set the surface potential of the electrophotographic photosensitive member to −600 V; irradiating the surface of the electrophotographic photosensitive member having a surface potential of −600 V with light having a predetermined quantity of light $E_1$, to set the surface potential of the electrophotographic photosensitive member to −150 V; and charging the surface of the electrophotographic photosensitive member having a surface potential of −150 V by means of the charging device set to the charging condition $C_1$;

wherein $V_B$, in units of volts, represents a surface potential of the electrophotographic photosensitive member obtained by: rotating the electrophotographic photosensitive member 5 times while charging the surface of the electrophotographic photosensitive member by means of a charging device set to a predetermined charging condition $C_2$ to set the surface potential of the electrophotographic photosensitive member to −150 V; and charging the surface of the electrophotographic photosensitive member having a surface potential of −150 V by means of a charging device set to the same condition as the charging condition $C_1$; and wherein d, in units of μm, represents the thickness of the hole transport layer; and wherein the following expression (II) is satisfied:

$$-5 \leqq -(-450-V_c) \leqq 2 \quad \text{(II)},$$

wherein $V_C$, in units of volts, represents a surface potential of the electrophotographic photosensitive member obtained by: rotating the electrophotographic photosensitive member 5 times while charging the surface of the electrophotographic photosensitive member by means of a charging device set to a predetermined charging condition $C_3$ to set the surface potential of the electrophotographic photosensitive member to a predetermined value $V_{CI}$, in units of volts, irradiating the surface of the electrophotographic photosensitive member having a surface potential of $V_{CI}$ with light having the same quantity of light as the quantity of light $E_1$ to set the surface potential of the electrophotographic photosensitive member to $V_{CII}$, in units of volts,; charging the surface of the electrophotographic photosensitive member having a surface potential of $V_{CII}$ by means of the charging device set to the charging condition $C_3$ to set the surface potential of the electrophotographic photosensitive member to −600 V; and irradiating the surface of the electrophotographic photosensitive member having a surface potential of −600 V with light having a predetermined quantity of light $E_2$, wherein when the electrophotographic photosensitive member is rotated 5 times while the surface of the electrophotographic photosensitive member is charged by means of the charging device set to the charging condition $C_1$ to set the surface potential of the electrophotographic photosensitive member to −600 V and the surface of the electrophotographic photosensitive member having a surface potential of −600 V is irradiated with light having a predetermined quantity of light to set the surface potential of the electrophotographic photosensitive member to −450 V , the predetermined quantity of light is $E_2$.

2. The electrophotographic photosensitive member according to claim 1, wherein m in the following approximate expression (III) is in a range of between $1\times10^{-4}$ and $2\times10^{-3}$ for $-200 \leqq V_X \leqq -120$:

$$(|-600-V_{AX}|-|-600-V_{AX}|)/d=m\cdot V+n \quad \text{(III)},$$

wherein $V_{AX}$, in units of volts, represents a surface potential of the electrophotographic photosensitive member obtained by: rotating the electrophotographic photosensitive member 5 times while charging the surface of the electrophotographic photosensitive member by means of the charging device set to the charging condition $C_1$ to set the surface potential of the electrophotographic photosensitive member to −600 V; irradiating the surface of the electrophotographic photosensitive member having a surface potential of −600 V with light to set the surface potential of the electrophotographic photosensitive member to $V_X$; and charging the surface of the electrophotographic photosensitive member having a surface potential of $V_X$ by means of the charging device set to the charging condition $C_1$;

wherein $V_{BX}$, in units of volts, represents a surface potential of the electrophotographic photosensitive member obtained by: rotating the electrophotographic photosensitive member 5 times while charging the surface of the electrophotographic photosensitive member by means of a charging device set to a predetermined charging condition $C_{2X}$ to set the surface potential of the electrophotographic photosensitive member to $V_X$; and charging the surface of the electrophotographic photosensitive member having a surface potential of $V_X$ by means of a charging device set to the same condition as the charging condition $C_1$;

wherein d represents the thickness of the hole transport layer; and m and n each represent a constant.

3. The electrophotographic photosensitive member according to claim 1 or 2, wherein the electron transport substance comprises a naphthalene carboxylic acid diimide compound.

4. A process cartridge, comprising the electrophotographic photosensitive member according to claim 1 or 2, and at least one means selected from the group consisting of charging means, developing means, transferring means, and cleaning means, the process cartridge integrally supporting the electrophotographic photosensitive member and the at least one means, wherein the process cartridge is detachably attached to a main body of an electrophotographic apparatus.

5. An electrophotographic apparatus, comprising said electrophotographic photosensitive member according to claim 1 or 2, and charging means, exposing means, developing means, and transferring means arranged around said electrophotographic photosensitive member.

6. The electrophotographic apparatus according to claim 5, wherein the electrophotographic apparatus has no electrostatic removal means on each of an upstream side of the charging means and a downstream side of the transferring means.

* * * * *

UNITED STATES PATENT AND TRADEMARK OFFICE

CERTIFICATE OF CORRECTION

PATENT NO. : 7,129,012 B2
APPLICATION NO. : 11/159164
DATED : October 31, 2006
INVENTOR(S) : Michiyo Sekiya et al.

It is certified that error appears in the above-identified patent and that said Letters Patent is hereby corrected as shown below:

COLUMN 1:
Line 50, “observed” should read --observed.--.
Line 51, “ahost” should read --ghost--.

COLUMN 3:
Line 7, “light E1” should read --light $E_1$--.

COLUMN 5:
Line 2, “II” should read --π--.
Line 34, “II” should read --π--.

COLUMN 6:
Line 22, “$V_{II}$” should read --$V_{CII}$--.
Line 30, “$E_2$ denotes” should read --E2 denotes--.
Line 59, “V will” should read --V) will--.

COLUMN 7:
Line 8, “volts;” should read --volts);--.
Line 11, “volts;” should read --volts);--.
Line 13, “light E2” should read --light $E_2$--.
Line 18, “V will” should read --V) will--.
Line 43, “600” (both occurrences) should read -- -600--.
Line 54, “finding” should read --findings--.

COLUMN 10:
Line 30, “dry” should read --wet--.

COLUMN 11:
Line 54, “substance,” should read --substances,--.

COLUMN 14:
Line 34, “-0 25 V” should read -- -0.25 V,--.

UNITED STATES PATENT AND TRADEMARK OFFICE

CERTIFICATE OF CORRECTION

PATENT NO. : 7,129,012 B2
APPLICATION NO. : 11/159164
DATED : October 31, 2006
INVENTOR(S) : Michiyo Sekiya et al.

It is certified that error appears in the above-identified patent and that said Letters Patent is hereby corrected as shown below:

COLUMN 17:

Lines 32-54:

| | |
|---|---|
| "-0.59 V | (1-1): |
| -0.51 V | (1-2): |
| -0.58 V | (1-3): |
| -0.46 V | (1-4): |
| -0.48 V | (1-5): |
| -0.47 V | (1-6): |
| -0.58 V | (1-7): |
| -0.58 V | (1-8): |
| -0.57 V | (1-9): |
| -0.49 V | (1-10): |
| -0.59 V | (1-11): |
| -0.45 V | (1-12): |
| -0.59 V | (1-13):" |

should read

| | |
|---|---|
| --(1-1): | -0.59 V |
| (1-2): | -0.51 V |
| (1-3): | -0.58 V |
| (1-4): | -0.46 V |
| (1-5): | -0.48 V |
| (1-6): | -0.47 V |
| (1-7): | -0.58 V |
| (1-8): | -0.58 V |
| (1-9): | -0.57 V |
| (1-10): | -0.49 V |
| (1-11): | -0.59 V |
| (1-12): | -0.45 V |
| (1-13): | -0.59 V--. |

UNITED STATES PATENT AND TRADEMARK OFFICE

CERTIFICATE OF CORRECTION

PATENT NO. : 7,129,012 B2
APPLICATION NO. : 11/159164
DATED : October 31, 2006
INVENTOR(S) : Michiyo Sekiya et al.

It is certified that error appears in the above-identified patent and that said Letters Patent is hereby corrected as shown below:

COLUMN 25:
Line 43, "25.1√," should read --25.1°,--.
Line 52, "-0.52 V)." should read -- -0.52 V)--.

COLUMN 31:
Line 57, "layer," should read --layer--.

COLUMN 49:
Line 67, "phthalocvanine" should read --phthalocyanine--.

COLUMN 50:
Line 41, "(I)" should read --(I),--.

COLUMN 51:
Line 16, "volts," should read --volts;--.
Line 22, "volts,;" should read --volts;--.
Line 48, "$V_{AX}$" (second occurrence) should read --$V_{BX}$--.

Signed and Sealed this

Tenth Day of February, 2009

JOHN DOLL
*Acting Director of the United States Patent and Trademark Office*